US005748758A

United States Patent [19]

Menasco, Jr. et al.

[11] Patent Number: 5,748,758

[45] Date of Patent: May 5, 1998

[54] ACOUSTIC AUDIO TRANSDUCER WITH AEROGEL DIAPHRAGM

[76] Inventors: Lawrence C. Menasco, Jr., 245 E. Surfside Dr., Port Hueneme, Calif. 93041; Jeffrey W. Menasco, 2340 Carol View Dr. #202 E, Cardiff by the Sea, Calif. 92007

[21] Appl. No.: 591,723

[22] Filed: Jan. 25, 1996

[51] Int. Cl.[6] ..... H04R 25/00

[52] U.S. Cl. ..... 381/176; 381/173; 381/191; 381/192; 381/205; 381/174; 423/338

[58] Field of Search ..... 381/168, 169, 381/176, 192, 203, 205, 115, 117; 181/242; 423/338; 502/233

[56] References Cited

U.S. PATENT DOCUMENTS

| | | | |
|---|---|---|---|
| 1,644,387 | 10/1927 | Kyle . | |
| 2,249,767 | 7/1941 | Kistler | 252/273 |
| 2,631,196 | 3/1953 | Janszen | 179/111 |
| 2,896,025 | 7/1959 | Janszen | 179/111 |
| 3,617,378 | 11/1971 | Beck | 117/68 |
| 3,773,976 | 11/1973 | Beveridge | 179/1 |
| 3,829,623 | 8/1974 | Willis et al. | 179/115.5 |
| 4,037,061 | 7/1977 | von Recklinghausen | 179/115.5 |
| 4,249,043 | 2/1981 | Morgan et al. | 179/111 |
| 4,289,936 | 9/1981 | Civitello | 179/111 |
| 4,316,062 | 2/1982 | Beveridge | 179/111 |
| 4,319,096 | 3/1982 | Winey | 179/115 |
| 4,331,840 | 5/1982 | Murphy et al. | 179/111 |
| 4,337,379 | 6/1982 | Nakaya | 179/115.5 |
| 4,395,592 | 7/1983 | Colangelo | 179/115 |
| 4,413,160 | 11/1983 | Ohyaba et al. | 179/115 |
| 4,461,932 | 7/1984 | Oyaba | 179/115 |
| 5,275,796 | 1/1994 | Tillotson et al. | 423/338 |
| 5,283,835 | 2/1994 | Athanas | 381/190 |
| 5,294,480 | 3/1994 | Mielke et al. | 428/240 |
| 5,306,555 | 4/1994 | Ramamurthi et al. | 428/289 |
| 5,311,095 | 5/1994 | Smith et al. | 310/334 |
| 5,409,683 | 4/1995 | Tillotson et al. | 423/338 |
| 5,430,805 | 7/1995 | Stevenson et al. | 381/203 |

*Primary Examiner*—Curtis A. Kuntz
*Assistant Examiner*—Rexford N. Barnie

[57] ABSTRACT

This invention describes an acoustic transducer, either speaker or microphone, that uses an aerogel diaphragm or an aerogel acoustic interface made of magnetic aerogel or conductive aerogel or both. In the case of a speaker, the aerogel diaphragm is directly driven either by electromagnetic or electrostatic means to reproduce high fidelity sound. In the case of a microphone, the aerogel diaphragm is modulated by acoustic energy, and in turn, the aerogel diaphragm electromagnetically or electrostatically modulates a field detection element resulting in a high fidelity electrical audio signal output.

8 Claims, 9 Drawing Sheets

ACOUSTIC AUDIO TRANSDUCER WITH AEROGEL DIAPHRAGM

BACKGROUND

1. Field of Invention

This invention relates to acoustic audio transducers, microphones, and loudspeakers, especially to those of electromagnetic or electrostatic type with planar diaphragms, specifically to a novel diaphragm material and means of directly driving the diaphragm material.

2. Discussion of Prior Art

The majority of acoustic transducers, microphones, and loudspeakers rely on a physically modulated interface or membrane or diaphragm to facilitate acoustic energy transfer between the transducer and ambient air. A large variety of design types, shapes and configurations have been devised to fill a multitude of application needs and cost criterion.

The greater majority of these rely on an indirect drive mechanism in the form of an electromagnetic coil or piezoelectric transducer driver mechanically attached to a diaphragm. The transducer driver is mechanically coupled typically to a cone shaped diaphragm at or near its vortex. The cone is allowed a degree of freedom to move back and forth along a single axis in a piston like action. The transducer driver serves as a means to convert acoustic or kinetic energy to and from electrical energy. The diaphragm is principally an impedance matching device between transducer driver and ambient air. It is the process of energy transference between transducer driver and diaphragm structure that allows for distortion of the acoustic signal. Because transducer driver and diaphragm are interfaced at limited points, the drive forces are unevenly distributed throughout the diaphragms structure. This results in inaccuracies in the conversion of acoustical information to electrical, or visa-versa. The inherent inertia of the mass of the diaphragm causes the far edges of the diaphragm to lag behind the actual transducer movement. At points farther from the transducer driver, air plays an increasing role in the impedance of the diaphragm, causing further distortion of the diaphragm and further degradation of the acoustic or audio signal. Those same lagging characteristics in the planar surface of the diaphragm along with the point source nature of the driving forces, as well as the flexible nature of the diaphragm itself, combine to cause unwanted mechanical resonate waves throughout the diaphragm, further distorting the acoustic signal.

Attempts to reduce mechanical distortion of the diaphragm and improve energy transference characteristics between transducer driver and diaphragm, have been a balance between three different "fixes" or approaches, with each approach having consequences of its own.

One approach has been to limit the size of the diaphragm in reference to the size of the transducer driver. This also effectively limits efficiency, dynamic range as well as limiting the frequency response to the upper frequencies.

A second approach has been to increase the rigidity of the diaphragm. The increased rigidity is usually at the expense of increased mass. In rare cases where the material is a nominal increase in mass, such as a lightweight ceramic, aluminum, or titanium diaphragm, the problems of resonant distortion within the diaphragm occur at higher frequencies, but are never completely eliminated.

A third approach has been an attempt to suppress any distortion by the use of dampening materials. Although such modifications allow for more accurate energy transference characteristics, it is most often at the expense of added mass, or reduced surface area of the diaphragm, thereby lowering either the frequency response or the amplitude and efficiency of the transducer unit as a whole.

So, the configuration of a diaphragm driven at a point source by a transducer driver remains problematic on a number of levels, particularly where an audio signal of low distortion is desired.

Attempts to design an acoustic transducer with more desirable performance characteristics has lead to alternate means and methods of driving a diaphragm. Efforts to reduce problems of inertia in regards to the mass of the diaphragm have also been addressed. The results have fallen into three general categories. They are ribbon, electrostatic, and a modification of the ribbon type, the embedded conductor type.

Out of these, the electrostatic speaker is a well known and moderately successful design. U.S. Pat. No. 1,644,387 Kyle, U.S. Pat. Nos. 2,631,196 and 2,896,025 Janzen, U.S. Pat. No. 4,249,043 Morgan et al; U.S. Pat. No. 4,289,936 Civitello et al; U.S. Pat. Nos. 3,773,976 and 4,316,062 Beveridge et al; and U.S. Pat. No. 4,331,840 Murphy et al; among other, describe various types of electrostatic transducers. Using electrostatic forces, an oscillating electrostatic field is created evenly across a large surface area diaphragm typically made of ultra-thin, ultra-lightweight mylar film or other plastic sheet, and coated with a conductive surface. The diaphragm is moderately tensioned in a frame, and allowed a degree of freedom to "warp" within the frame. The frame and diaphragm within are place in close proximity to a fixed grid, and in more recent designs, between two fixed grids. The grid or grids are charged with a high direct current or "DC" voltage potential. The voltage potential of the diaphragm fluctuates in direct proportion to an audio signal input. The voltage potentials required to create adequate electrostatic force to drive the diaphragm are significant, and limited by the air's insulation ability. This disadvantage is further exacerbated by the relative weakness of an electrostatic field to begin with. These drawbacks require an increase in surface area of the diaphragm to achieve an equivalent signal pressure level. Increasing the radiative area increases the spread of acoustic signal, particularly those upper frequencies having to do with directionality. This effectively "smears" the acoustic image. Although the overall mass of an electrostatic diaphragm is typically insignificant compared to a conventional cone type diaphragm, the actual portion of mass attributed to the conductive layer used to carry the electrostatic field used to drive the diaphragm is insignificant to the mass of the underlying film, less than 1%. This means that the ratio of passive mass to active mass is still very large, and efficiency is still a problem.

A condenser microphone, the acoustic transducer complement to the electrostatic speaker, was described as early as 1918 by Edward C. Wente. Typically a condenser microphone consist of a diaphragm of similar mass density and inertia characteristics to that of an electrostatic speaker, in a frame of significantly smaller diameter. Although condenser type microphones exhibit among the best characteristics of existing microphone design to date, they still suffers from problems of inertia in regards to its diaphragm being made of materials with densities typical of a solid.

The ribbon type transducer, another type of acoustic transducer with a directly driven diaphragm, makes use of electromagnetic forces. Because the strength of a magnetic field is primarily a function of current amplitude, it is not limited by the same drive constraints as the above electrostatic. U.S. Pat. No. 4,319,096 Winey et al; U.S. Pat. No. 4,395,592 Colangelo et al; U.S. Pat. Nos. 4,461,932 and 4,413,160 Ohyaba et al; along with others, describe various types of ribbon transducers. Oscillating current is passed through one or more conductive ribbon strips in the presence of a fixed electromagnetic field. The fixed field is usually derived from a bar magnet, or composite strip magnets. The oscillating current creates a corresponding oscillating electromagnetic field around the ribbon. The oscillating field around the ribbon reacts with the fixed magnetic field, causing the ribbon diaphragm to move in air. The movement is in proportion to the drive current that created the oscillating field. The relatively small surface area of the ribbon limits amplitude response as well as frequency response to approximately the 1 kHz to 50 kHz range. Ribbon transducers using more than one ribbon exhibit phasing problems in the upper frequencies because of multiple points of signal origin. Also, some ribbon transducers exhibit edge distortion problems due to micro-turbulence generated by the ribbons edge.

Again, a microphone version using the ribbon principles is known to the art as an input device, but suffers from limited interface angles to the audio source, largely due to distortion created by acoustic energy impinging on edge.

The third type of ultra-light diaphragm transducer, the embedded conductor is essentially a modification of the ribbon type. U.S. Pat. No. 3,829,623 Willis et al; U.S. Pat. No. 4,037,061 von Recklinghausen et al; U.S. Pat. No. 4,337,379 Nakaya et al; and U.S. Pat. No. 5,430,805 Stevenson; with others, give variations on this type of transducer design. Essentially, this type of acoustic transducer configuration is a cross between an electrostatic and electromagnetic speaker. Thin conductors have been embedded in or otherwise incorporated throughout the large surface area of a thin diaphragm, and made to react against an electromagnet field. The field, typically made of fixed magnetic strips, is approximately aligned to the conductors within the diaphragm. When oscillating current passes through the conductors, an oscillating electromagnetic field in kind is made to react to the fixed magnets, causing the diaphragm to move across its plane. Because the conductors are tied together by the diaphragm medium, coherence across the diaphragm plane is improved. And because of the increase in surface area, low frequency response is far superior to that of its ribbon cousin. But the increased surface area reintroduces the problem of acoustic image smearing. Also, an increase in thickness of the diaphragm is required to accommodate the conductor and its increased drive energies. With the added mass of the conductor and supporting diaphragm, the problem of inertia again plays a part in performance of this type of design.

Other variations of a directly driven diaphragm transducers have been offered.

U.S. Pat. No. 5,283,835 Athanas et al. describes an acoustic transducer using a diaphragm with a ferroelectric layer piezoelectric plastic in an elongated strip with a directional displacement oriented laterally across the strip. Although the transducer allows for direct drive of the diaphragm, the transducer suffers from limited frequency response and acoustic volume due to the limited displacement of the diaphragm. Because the transducers are in the form of strips, acoustic image smearing is again a problem.

OBJECTS AND ADVANTAGES

A theoretical ideal audio acoustic transducer would be one with a diaphragm having a relative mass density approaching the relative densities of ambient air for a superior kinetic impedance match. Furthermore, the diaphragm's bulk volume would be formed from materials capable of directly coupling to the reactant electrical fields, thereby minimizing mechanically induced intermodulation distortion. Furthermore, the drive means would be electrical in nature, preferably be electromagnetic or electrostatic.

It is therefore a principal object of this invention to provide for an acoustic transducer that employs an acoustical interface or membrane or pickup element or diaphragm, hereafter referred to as a diaphragm. This diaphragm would be fabricated from a novel material consisting of xerogel or xgel or aerogel substances, herein referred to aerogel. The diaphragm could also be made of an aerogel composite material. The diaphragm would have at least one acoustic coupling interface, and the diaphragm material would be capable of being driven directly by either electromagnetic or electrostatic means. Furthermore, the diaphragm material would have a relative density approaching the density of ambient air, thereby being several orders of magnitude lighter than conventional solid diaphragm material.

It is another object of this invention to provide for a number of embodiments, and novel methods to modulate the embodiments, including but not limited to Bessel array modulation, phase array modulation, and complex array modulation.

The nature of aerogel diaphragm material is such that it can be made from a variety of substances with magnetic or conductive properties or both. Moreover, the aerogel diaphragm can be fabricated in a large variety of shapes, thicknesses, densities, electrical resistances and magnetic permeabilities. It is thus an object of this invention to provide for a number of acoustic transducer configurations and the means to drive the aerogel diaphragms used therein. These configurations and means included but not limited to: large planar diaphragms; small diameter diaphragms; cylindrical, tubular, or rod shaped diaphragms; aerogel transducers with large volume displacements; electromagnetically driven and electrostatic driven aerogel transducers.

It is another object to provide for means for an aerogel transducer to be configured as an acoustic input device as well as an output device, with exceptional impedance matching to ambient air compared to conventional diaphragms.

In the case of an aerogel diaphragms being electromagnetically driven, it is still another object of this invention to provide means to increase field strength and field densities of the electromagnetic fields within the aerogel diaphragm and surrounding transducer, thereby increasing overall efficiency, either by using magnetically permeable materials or magnetically permeable composites, including but not limited to ferrous materials, and magnetically permeable plastic composites, as a means to concentrate and direct magnetic fields directly throughout the aerogel diaphragm.

It is another object of this invention to provide an alternate means for improving signal strength of the acoustic transducer through an increase in the field densities of the electromagnetic drive fields, by the use of embedded conductors placed spatially in an aerogel diaphragm.

It is still another object of this invention to provide for a novel concept in audio acoustic imaging and comprehensive means thereof to drive an aerogel diaphragm. This concept relies upon the nature of an aerogel diaphragm, in as much as any portion of it's bulk medium can be directly driven and displaced substantially independently from any other arbitrary portion. This ability would enable a diaphragm to reflect a complex pressure gradient pattern, emulating a spatial acoustic effect similar to an acoustical portal or an "acoustic window". We, the inventors, believe this concept to be a novel and significant departure from conventional acoustic design and a means to more accurately represent a real live acoustic signal.

In the description that follows, other objects and embodiments will become obvious and apparent.

| | | | |
|---|---|---|---|
| 20: | aerogel diaphragm | 60: | backplate |
| 22: | electromagnetic drive coil | 62: | acoustic vent holes |
| 24: | inductive core spindle | 64: | magnetic field focusing ring |
| 26: | fixed base | 66: | aerogel diaphragm |
| 28: | oscillating electromagnetic field | 68: | lower inside diameter |
| 30: | electronic circuitry | 70: | upper inside diameter |
| 32: | audio signal input | 72: | electromagnetic drive coil array |
| 34: | voltage step-up transformer | 74: | electromagnetic drive coil |
| 36: | high voltage DC power supply | 76: | core spindle array |
| 38: | grid bias voltage | 78: | core spindle |
| 40: | high voltage audio signal | 80: | backplate |
| 42a: | fixed electrostatic drive grid | 82: | magnetic field focusing ring |
| 42b: | fixed electrostatic drive grid | 84: | aerogel diaphragm |
| 44: | aerogel diaphragm | 86: | acoustic vent holes |
| 46: | aerogel diaphragm | 88: | lower inside diameter |
| 48: | embedded conductors | 90: | upper inside diameter |
| 50: | fixed permanent magnetic backplate | 92: | conductive aerogel diaphragm |
| 52: | audio amplifier | 94: | support circuitry |
| 54: | line level audio input | 96: | frame |
| 56: | electromagnetic drive coil | 98: | fixed conductive backplate |
| 58: | core spindle | 100: | acoustic vent holes |
| 102: | backplate frame | 130: | audio source beta |
| 104: | bias voltage | 132: | audio source gamma |
| 106: | resistor | 134: | audio window |
| 108: | audio output signal | 136: | aerogel audio speaker window, complex displacement, not to scale, actual isometric view |
| 110: | condenser microphone elements | | |
| 112: | mounting ring | | |
| 114: | upper protective audio screen | 138: | aerogel diaphragm |
| 116: | microphone body | 140: | embedded spiral conductor |
| 118: | magnetic aerogel diaphragm | 142: | diaphragm suspension ring |
| 120: | aerogel frame | 144: | audio output signal |
| 122: | diaphragm suspension | 146: | permanent magnet |
| 124: | pickup coil | 148: | north pole |
| 126: | lower protective audio screen | 150: | south pole |
| 128: | audio source alpha | 152: | permanent magnet suspension ring |

SUMMARY

This invention describes in principle an acoustic transducer that electromagnetically or electrostatically modulates an aerogel diaphragm to create a high fidelity audio speaker. The diaphragm is made of magnetic or magnetically permeable materials, or conductive materials, or a combination of both. The reciprocal arrangement can be used as a microphone or audio pickup.

DESCRIPTION OF INVENTION

Figure 1:
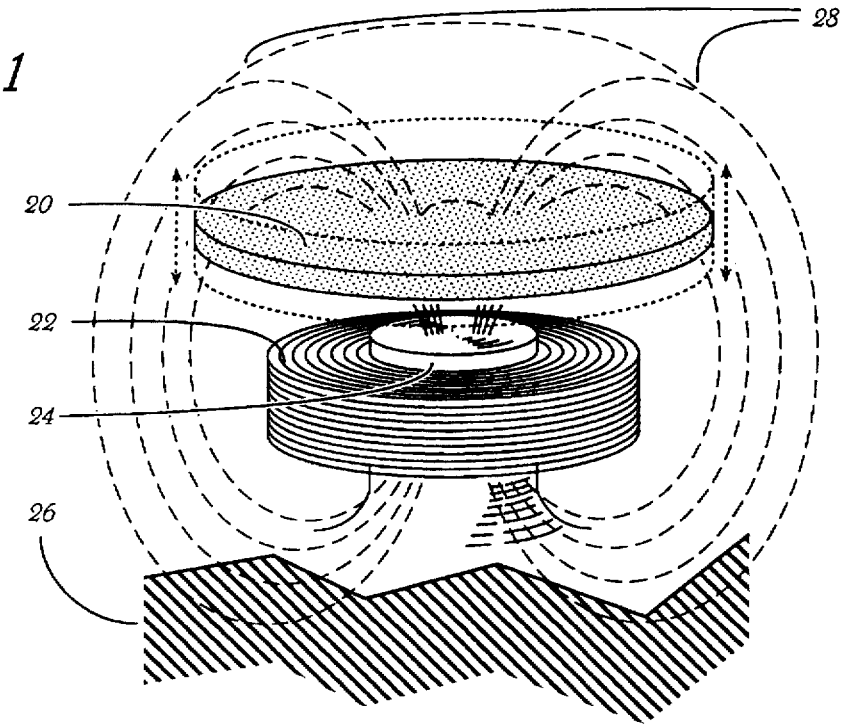
FIG. 1: Basic electromagnetic aerogel speaker
Figure 2:
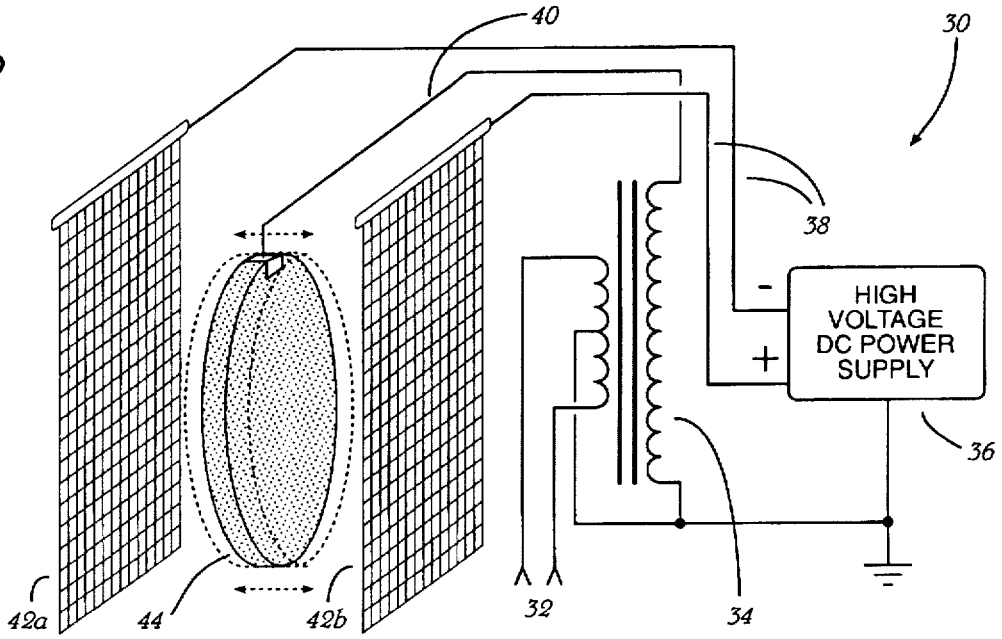
FIG. 2: Basic electrostatic aerogel speaker

FIG. 1 and FIG. 2 illustrate the most basic embodiments of an acoustic transducer using an aerogel diaphragm. The various compositions and methods of fabricating aerogels or aerogel composites are known to one skilled in the art of aerogel manufacturing.

FIG. 1 illustrates a basic electromagnetic aerogel speaker. An aerogel diaphragm 20 is formed from magnetically permeable aerogel. Diaphragm 20 can also be made of ferrous or magnetic aerogel, or aerogel composite with similar magnetic reactance characteristics.

Diaphragm 20 is made to oscillate by means of an oscillating electromagnetic field 28. Electromagnetic field 28 is created by an electromagnetic drive coil 22. Coil 22 is attached to an inductive core spindle 24, also made of ferrous or magnetically permeable substances. The inductive core spindle 24 is used to focus and direct the oscillating electromagnetic field 28 to interact with the aerogel diaphragm 20. The inductive core spindle 24 is attached to a fixed base 26 in reference to the aerogel diaphragm 20. The fixed base 26 can also be made of ferrous or magnetically permeable substances to further focus the oscillating electromagnetic field 28.

FIG. 2 illustrates a basic electrostatic aerogel speaker. In electronic circuitry 30, an audio signal input 32 from a typical audio amplifier (not shown) drives a voltage step-up transformer 34. This significantly increases the voltage of the original audio signal input 32. A resulting high voltage audio signal 40 is used to create a modulated electrostatic field applied to an aerogel diaphragm 44. The audio signal 40 achieves an alternating current or "AC" voltage potential of 1,000 to 5,000 volts or more. Diaphragm 44 is made of electrically conductive aerogel. Diaphragm 44 is allowed a degree of freedom to oscillate between two fixed electrostatic grids 42*a* and 42*b*. Grids 42*a* and 42*b* are electrostatically charged by a grid bias voltage 38 with a direct current or "DC" voltage potential of 1,000 to 10,000 volts. The bias voltage 38 is generated by a high voltage DC power supply 36. As a result, diaphragm 44 is made to move in kind and in proportion to the high voltage audio signal 40.

Figure 3:
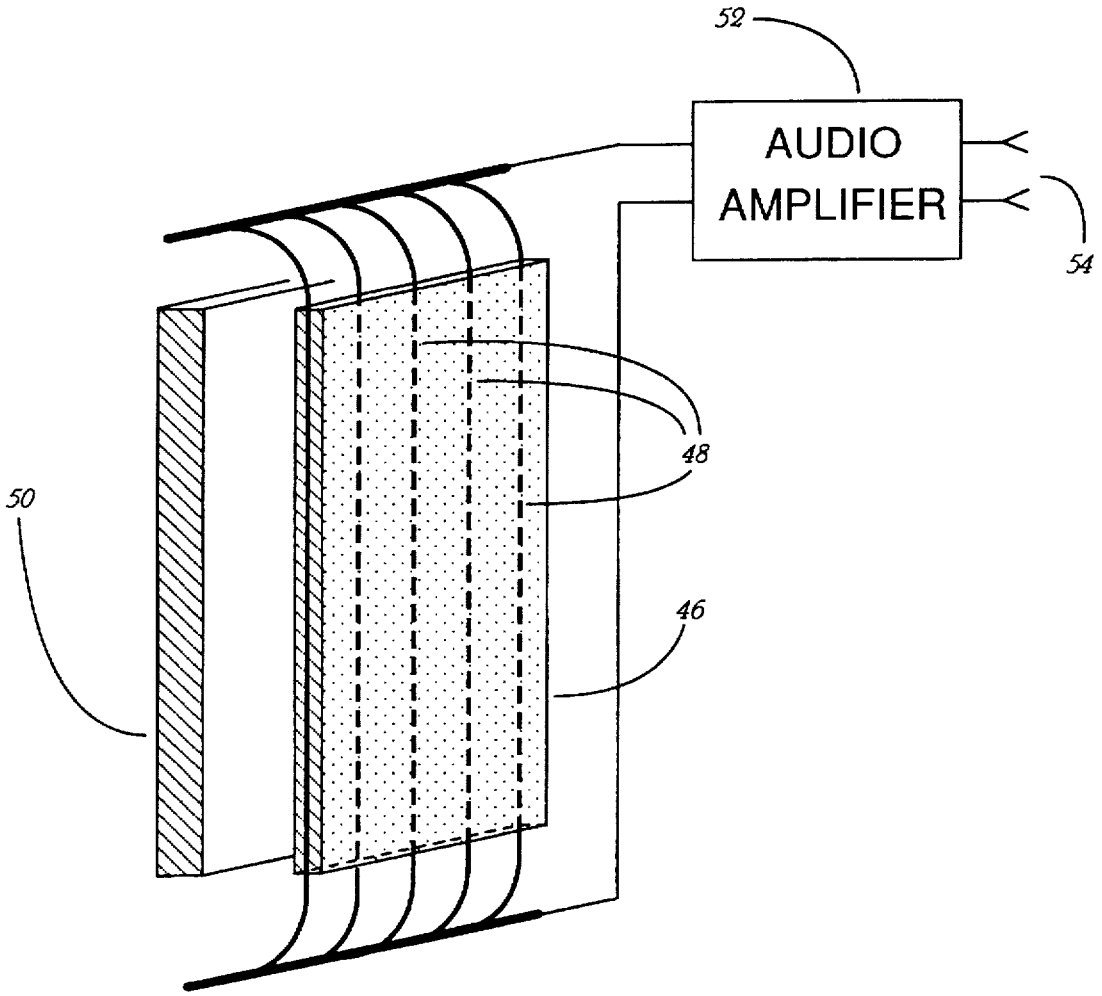
FIG. 3: Electromagnetic speaker using an aerogel diaphragm with embedded conductors

FIG. 3 illustrates an electromagnetic speaker employing an aerogel diaphragm with embedded conductors. An aerogel diaphragm 46 is made of a non-magnetic aerogel for a passively driven diaphragm. Alternatively, for an actively driven diaphragm, aerogel diaphragm 46 can be formed from a ferrous aerogel, or a magnetically permeable aerogel, or an aerogel composite with similar magnetic reactance characteristics. Diaphragm 46 is fabricated with one or more embedded conductors 48. Conductors 48 are spatially placed within the bulk volume of diaphragm 46. An audio amplifier 52 derives its signal from a line level audio input 54. Audio amplifier 52 is used to directly drive the embedded conductors 48. A fixed permanent magnetic backplate 50 provides for a strong permanent magnetic field (not shown). The permanent magnetic field reacts to the fluctuating magnetic field (not shown) emanating from conductors 48. The fluctuating magnetic field is a result of current from amplifier 52 running through conductors 48. The interaction of the magnetic fields causes embedded conductors 48 to move. The movement of conductors 48 is in proportion to the amplitude of the drive current from amplifier 52. The movement of conductors 48 causes diaphragm 46 surrounding the embedded conductors 48 to move in kind.

FIG. 4, FIG. 5, FIG. 6 and FIG. 7 further detail two basic variations of an electromagnetically driven aerogel speaker.

Figure 4:
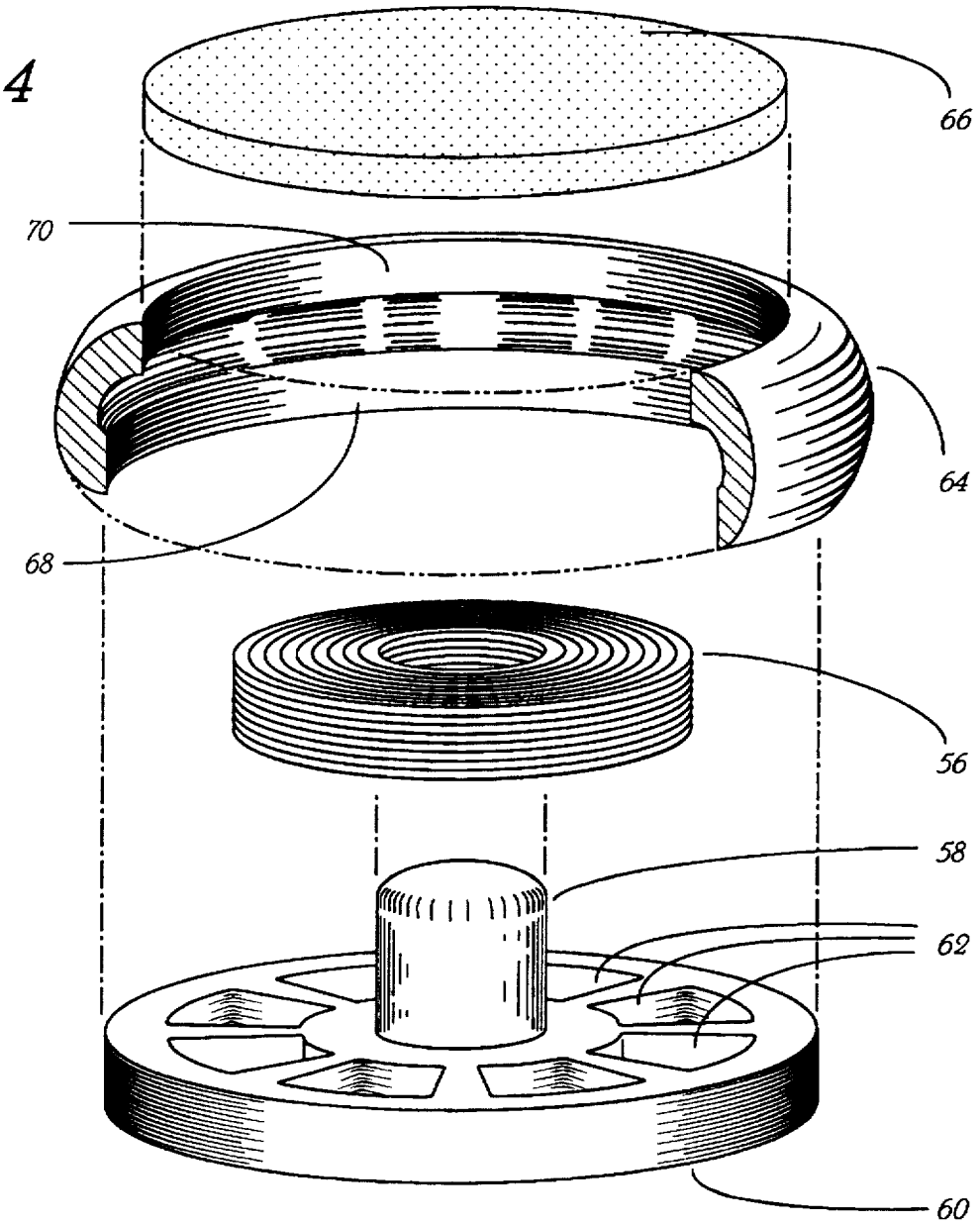
FIG. 4: Single driver electromagnetic ferrous aerogel speaker with magnetic field focusing ring, exploded view
Figure 5:
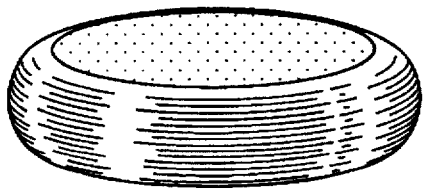
FIG. 5: Single driver electromagnetic ferrous aerogel speaker with magnetic field focusing ring, external view

FIG. 4 depicts an exploded cut-away view of a single driver electromagnetic ferrous aerogel speaker with a magnetic field focusing ring. FIG. 5 is an external view of FIG. 4. An electromagnetic drive coil 56 is mounted on a core spindle 58 and bookplate 60. Spindle 58 and backplate 60 are made of ferrous material or other magnetically permeable material. A magnetic field focusing ring 64 jackets the electromagnetic drive coil 56, core spindle 58 and backplate 60. Backplate 60 is joined to a lower inside diameter 68 of the magnetic field focusing ring 64. Focusing ring 64 is made of material similar to, or the same as the material of core spindle 58 and backplate 60. An aerogel diaphragm 66 is made to seal the top of the speaker assembly as seen in FIG. 5. Diaphragm 66 fits into an upper inside diameter 70 of the magnetic field focusing ring 64. Diaphragm 66 is made of ferrous or magnetic or magnetically permeable aerogel, or aerogel composite with similar magnetic reactance characteristics. A set of acoustic vent holes 62 is provided in backplate 60. Vent holes 62 allow for pressure equalization of the interior of the speaker for improved efficiency.

Figure 6:
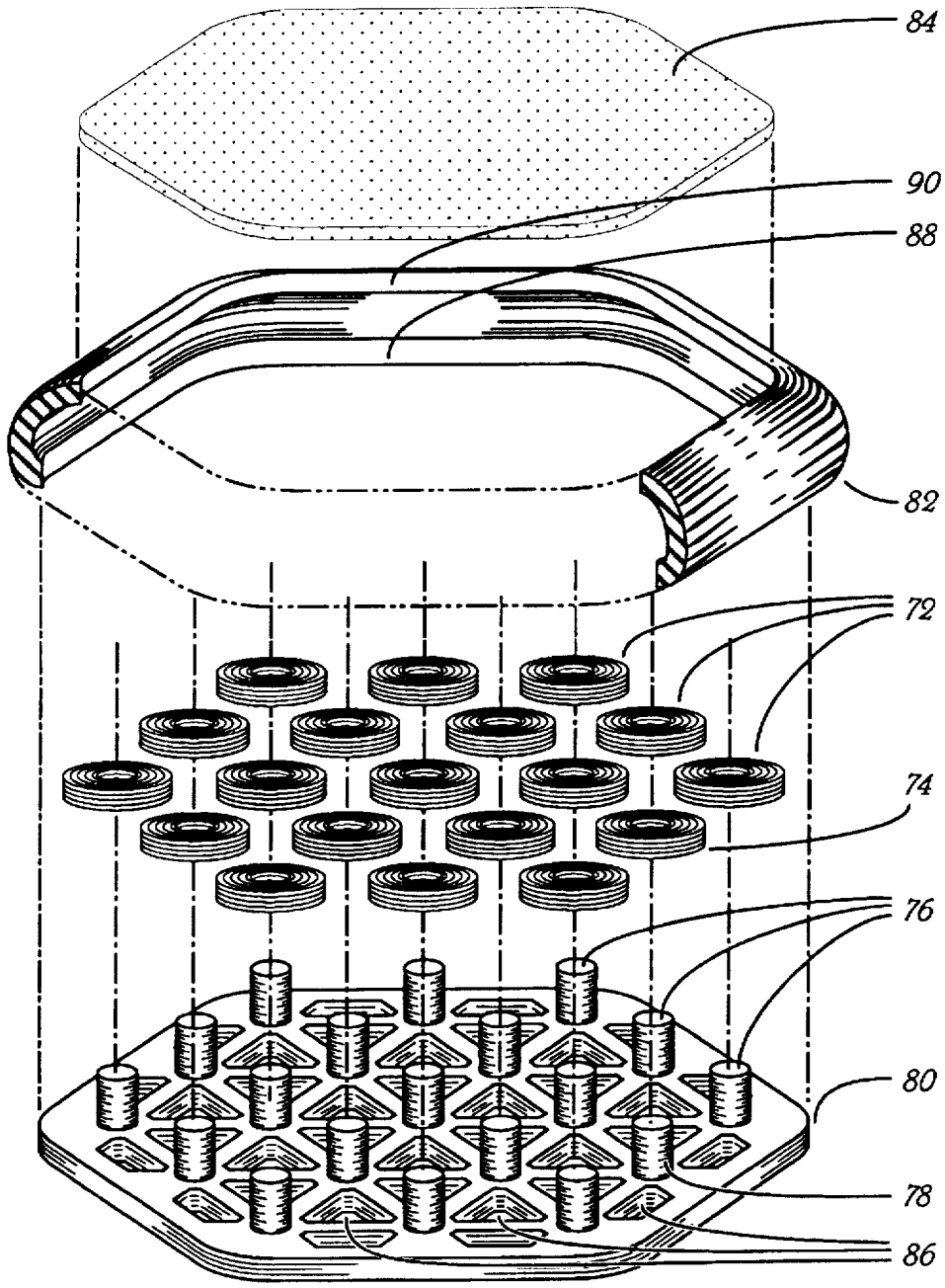
FIG. 6: Hexagonal electromagnetic driver array aerogel speaker, exploded view
Figure 7:
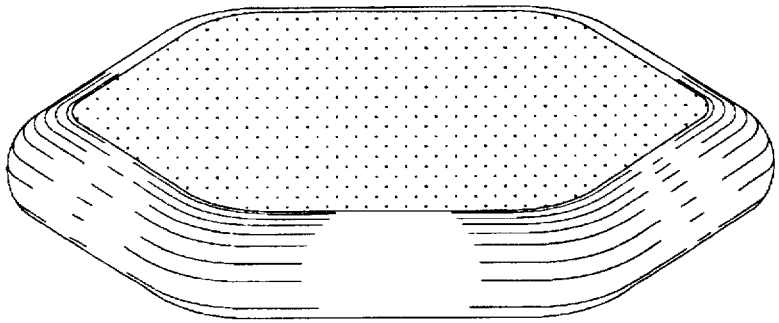
FIG. 7: Hexagonal electromagnetic driver array aerogel speaker, external view

FIG. 6 and FIG. 7 depict a hexagonal electromagnetic driver array aerogel speaker. FIG. 6 is an exploded cut-away view, while FIG. 7 depicts the external view of FIG. 6.

FIG. 6 depicts an electromagnetic drive coil 74, part of a group of drive coils arranged in a hexagonal pattern. The group of drive coils comprises an electromagnetic drive coil array 72. Coil array 72 is mounted to a core spindle array 76. Spindle array 76 is composed of individual core spindles 78. Spindle array 76 is mounted to a backplate 80. A magnetic field focusing ring 82 is made to jacket the electromagnetic drive coil array 72, core spindle array 76 and backplate 80. Backplate 80 is joined to a lower inside diameter 88 of the magnetic field focusing ring 82. Focusing ring 82 is shaped to accommodate the hexagonal shape of backplate 80. An aerogel diaphragm 84 seals the top of the speaker assembly as seen in FIG. 7, by fitting into an upper inside diameter 90 of the magnetic field focusing ring 82. Diaphragm 84 is formed from aerogel material that is ferrous or magnetic or magnetically permeable, or from aerogel composites with similar magnetic characteristics. A group of acoustic vent holes 86 is provided in the backplate 80 to allow for pressure equalization of the interior of the speaker.

FIGS. 8, 9, 10 and 11 show embodiments of various acoustic audio transducers incorporating an aerogel diaphragm in the form of microphones. Again, two basic types are illustrated using both electromagnetic and electrostatic means.

Figure 8:
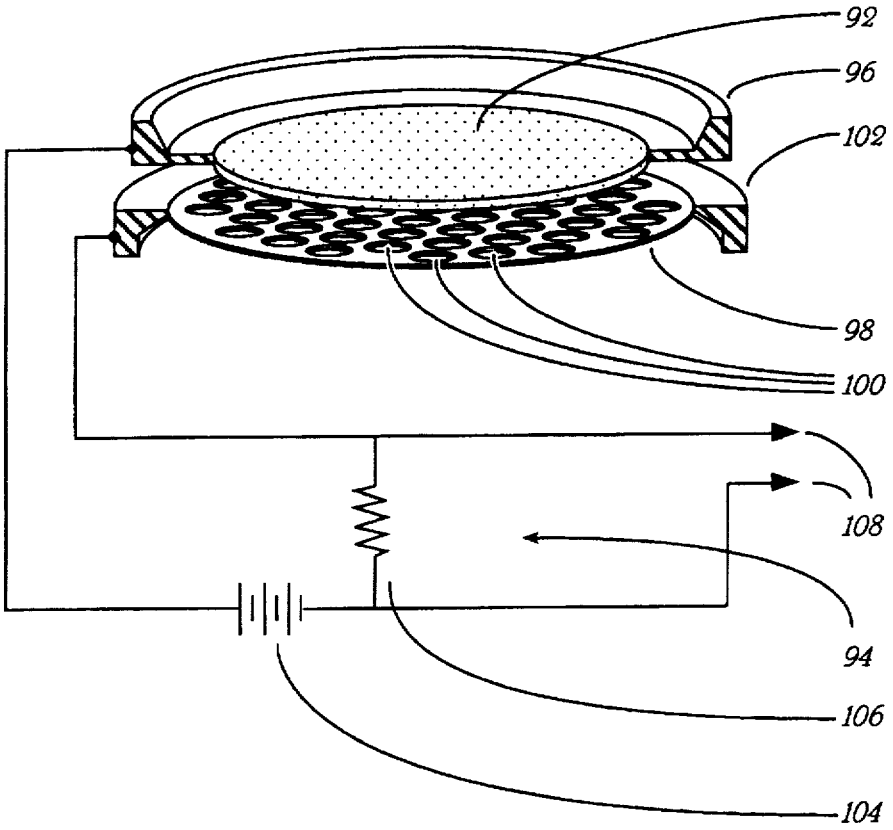
FIG. 8: Close-up of condenser type microphone element with conductive aerogel diaphragm
Figure 9:
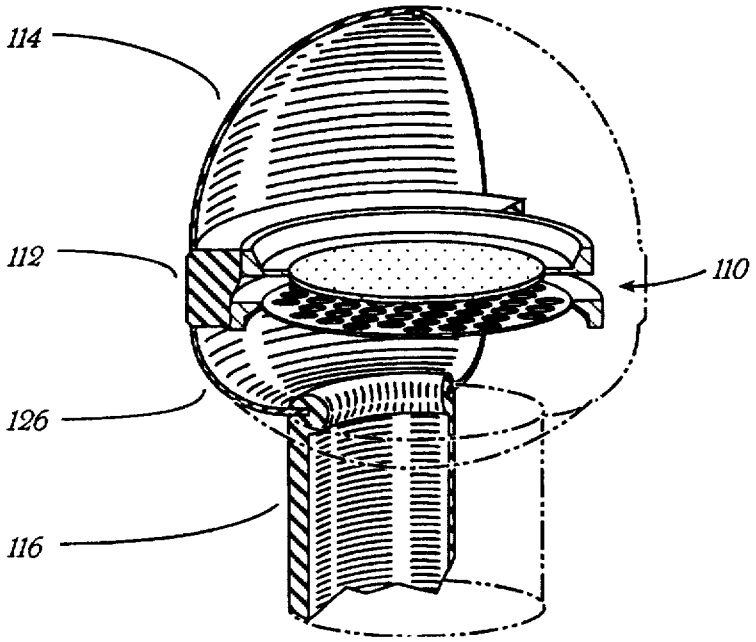
FIG. 9: Basic condenser type microphone with conductive aerogel diaphragm

FIG. 8 and FIG. 9 illustrate components of a typical electrostatic or condenser type microphone using an aerogel diaphragm. In FIG. 8, a close-up cut-away view of condenser microphone elements with an aerogel diaphragm is shown connected to a schematized drawing of support circuitry. A conductive aerogel diaphragm 92 in a frame 96 is held in close proximity to a fixed conductive backplate 98. Conductive backplate 98 is also held in a bookplate frame 102. Conductive backplate 98 is covered with an array of acoustic vent holes 100 allowing for pressure equalization. Diaphragm 92 is allow a certain degree of freedom to move relative to the proximity of backplate 98. The movement of diaphragm 92 is in proportion to audio acoustic energy impinging on its surface. Within a support circuitry 94, a fixed DC bias voltage 104 is applied directly to diaphragm 92 and indirectly to backplate 98 through a resistor 106. DC bias voltage 104 is between 1.5 volts and 50 volts. Resistor 106 has a nominal resistance of 1 Megohms to 10 Megohms, depending on the bias voltage and capacitive load of diaphragm 92 and backplate 98. Any change in relative distance between diaphragm 92 and backplate 98 results in a change in capacitance. The change in capacitance registers as a temporary charge imbalance, resulting in a voltage differential across resistor 106. The differential voltage provides an audio output signal 108.

FIG. 9 shows a more complete view of a condenser microphone in a cut-away view, including elements illustrated in FIG. 8. A set of condenser microphone elements 110 is shown mounted in an insulating mounting frame 112. Mounting frame 112 also joins an upper protective audio screen 114 and a lower protective audio screen 126. Audio screen 126 can serves as a structural union for a microphone body 116.

Figure 10:
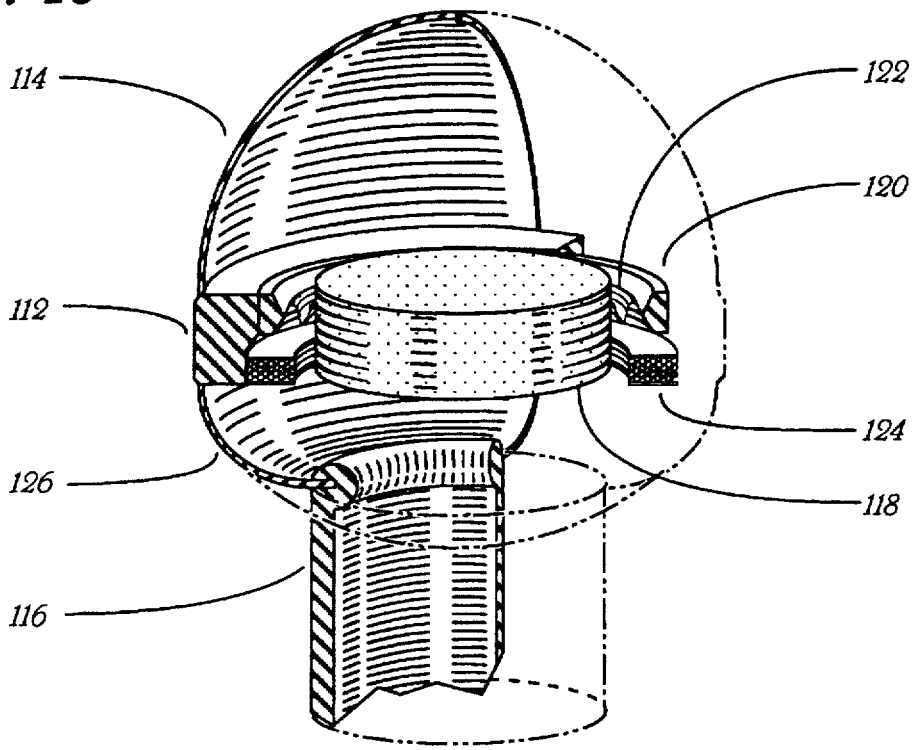
FIG. 10: Basic electromagnetic dynamic type microphone with magnetic aerogel diaphragm

FIG. 10 is similar to FIG. 8. FIG. 10 make use of a dynamic type element. FIG. 10 illustrates a basic electromagnetic dynamic microphone with magnetic aerogel diaphragm. As in FIG. 8, FIG. 10 shows mounting frame 112 attached to audio screen 114 and 126. Audio screen 126 again, serves as a structural union to body 116. A magnetic aerogel diaphragm 118 is composed of an aerogel or aerogel composite. Diaphragm 118 is magnetized with a permanent magnetic moment. Diaphragm 118 is attached to an aerogel frame 120 through a diaphragm suspension 122. Frame 120 is in turn attached to mounting frame 112. Diaphragm 118 is cylindrical in shape and volume. The cylindrical shape of diaphragm 118 passes through an electromagnetic pickup coil 124 mounted to the mounting frame 112. Diaphragm 118 is allowed a degree of freedom of vertical movement by suspension 122. The movement of diaphragm 118 is in proportion to acoustic energy impinging on its surface. As diaphragm 118 moves, its magnetic field passes through pickup coil 124, thereby generating a current within the coil that can be used as an electrical audio signal.

Figure 12:
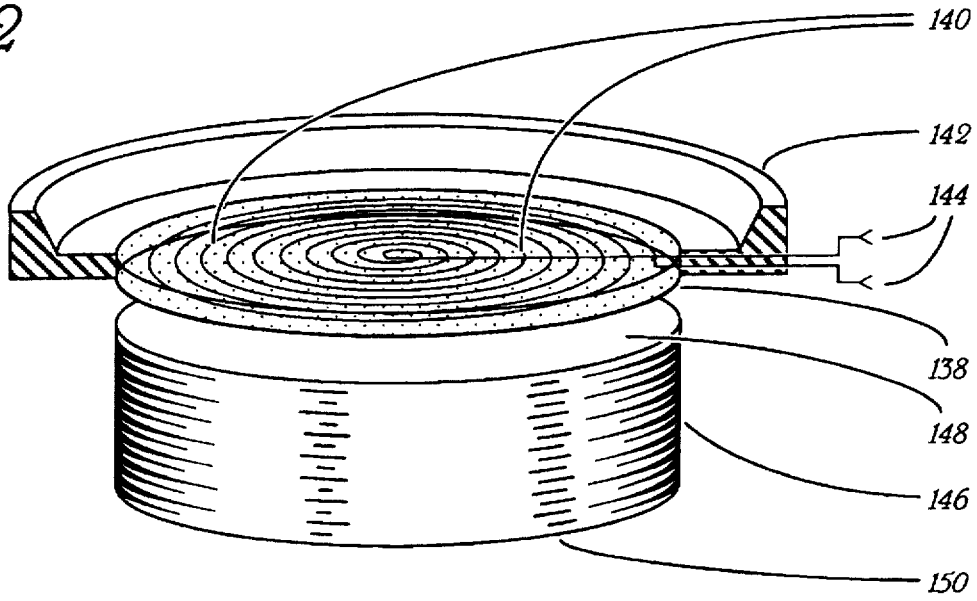
FIG. 12: Close-up of a dynamic type microphone element with spiral embedded conductors in aerogel diaphragm
Figure 13:
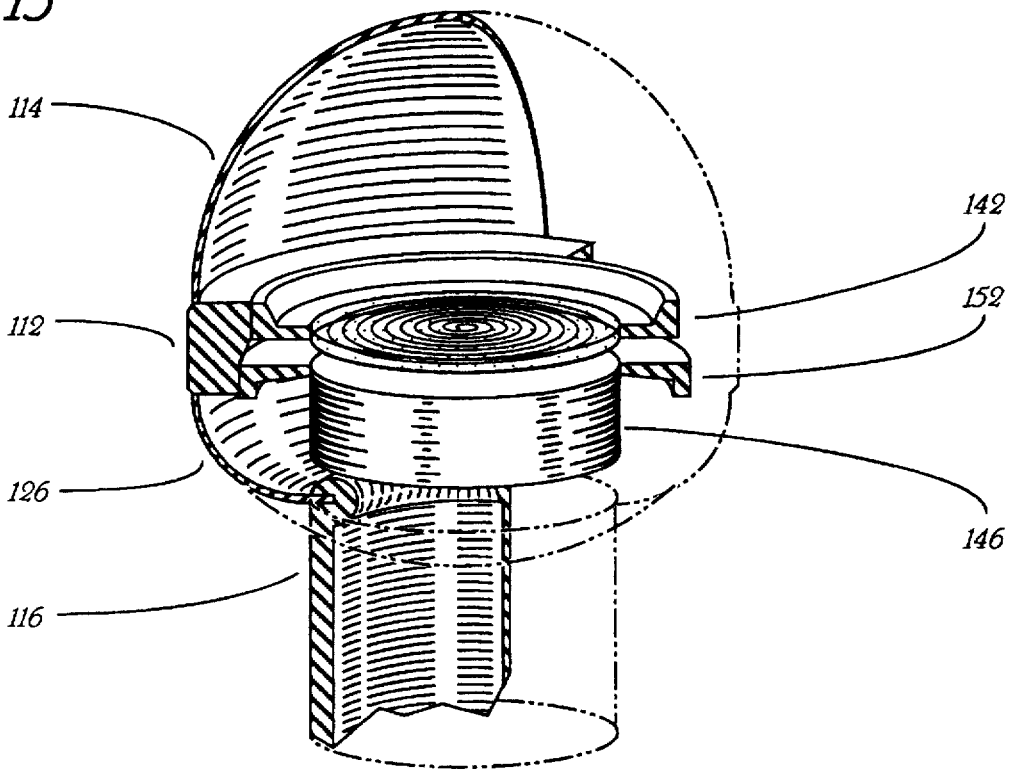
FIG. 13: Basic dynamic type microphone with spiral embedded conductors in an aerogel diaphragm

FIG. 12 and FIG. 13 are another embodiment of a dynamic type element, using an embedded conductor in an aerogel diaphragm viewed in a cut-away cross-section.

In FIG. 12, an aerogel diaphragm 138 is fabricated with an embedded spiral conductor 140 and suspended by a diaphragm suspension ring 142. A permanent magnet 146 with a strong magnetic field is placed in proximity to diaphragm 138. The magnetic field (not shown) of magnet 146 is oriented with a north pole 148 and a south pole 150 emerging from opposite faces of the cylindrical shape. One face of magnet 146 is facing diaphragm 138 and conductor 140. Acoustic energy impinging upon diaphragm 138 cause diaphragm 138 along with conductor 140 to move in reference to permanent magnet 146. As conductor 140 passes through the strong magnetic field of permanent magnet 146, a modulated current is created in proportion to the impinging acoustic energy, resulting in an audio output signal 144.

In FIG. 13, the elements illustrated in FIG. 12 are placed in mounting ring 112. Permanent magnet 146 is held in place by a permanent magnet suspension ring 152. Audio screen 114 is attached to mounting ring 112 which in turn, is mounted to audio screen 126. Audio screen 126 is mounted to body 116.

Figure 11:
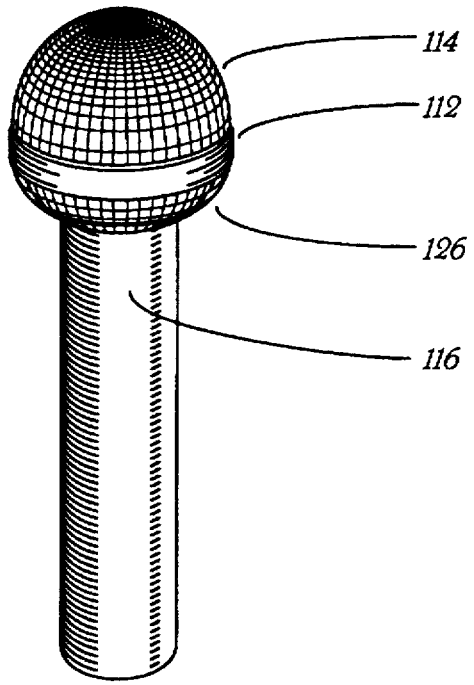
FIG. 11: Basic aerogel microphone, external view

FIG. 11 depicts a more complete external view of FIGS. 9, 10, and FIG. 13.

FIGS. 14, 15, 16, 17, and 18 depict a preferred and unique embodiment and application of an acoustic transducer with an aerogel diaphragm, designated herein as an audio window. The figures are meant to illustrate a concept, as well as basic principles thereof, and do not represent an actual depiction of real audio, as such a representation would require extremely high resolution graphics, and would do little to improve upon the instructiveness of the illustrations herein. But at the same time, the limitations of the illustrations should not infer any limitations upon the invention's ability to implement the concept of the audio window as presented.

Figure 14:
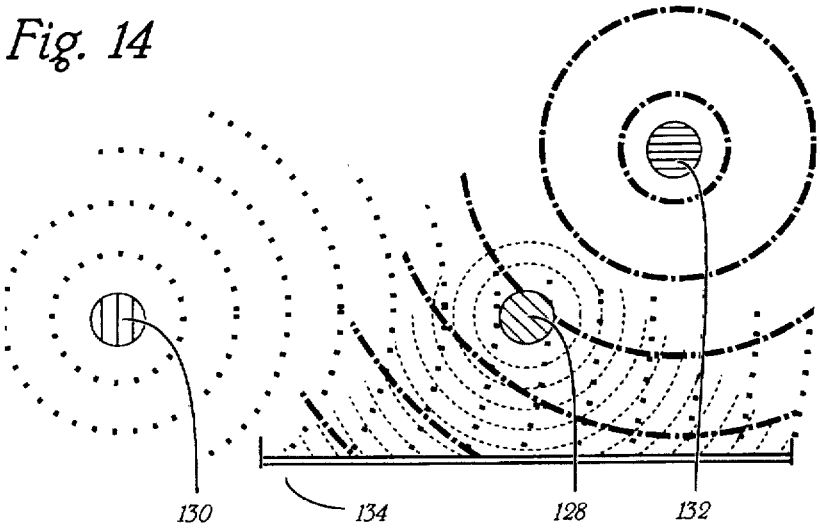
FIG. 14: An aerogel window speaker with illustrated spatially arbitrary audio sources, vertical view
Figure 14:
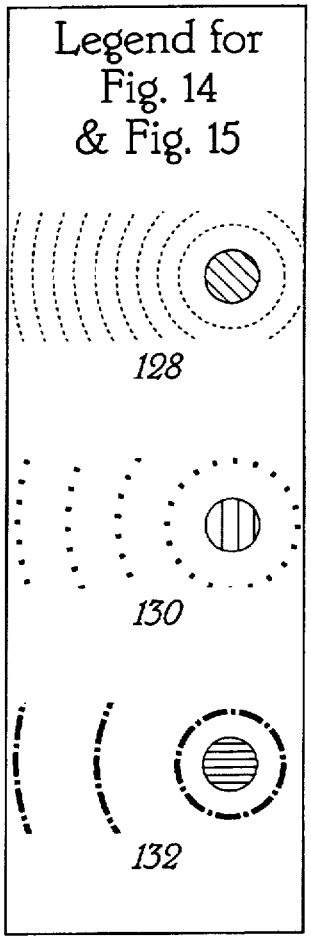
Figure 15:
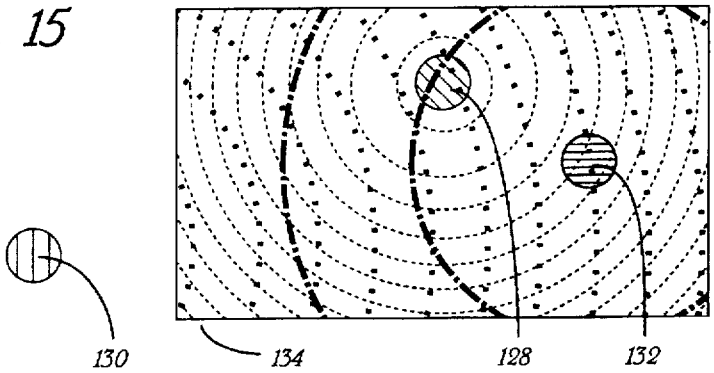
FIG. 15: An aerogel window speaker with illustrated spatially arbitrary audio sources, horizontal view
Figure 16:
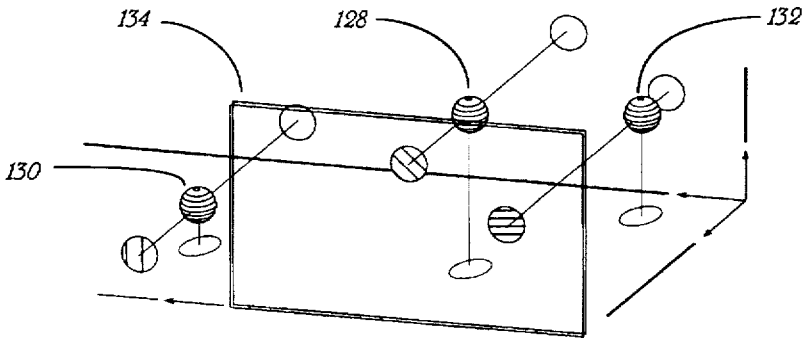
FIG. 16: An aerogel window speaker with illustrated spatially arbitrary audio sources, 3-dimensional view

FIGS. 14, 15, and 16 show three different views of an audio window 134. Audio window 134 is depicted spatially referenced to a group of three different audio sources, an audio source alpha 128, an second audio source beta 130, and a third audio source gamma 132. Each audio source is spatially independent from the other. Their corresponding wave patterns are also represented. FIG. 14 is a schematic representation of audio sources 128, 130, and 132 in reference to window 134. An overhead view is depicted. Source alpha 128 is represented approximately centered and forward towards window 134. Alpha 128's wave pattern shows relatively short period wavelengths representing relatively high frequency content. Source beta 130 is represented off center to the left in reference to window 134, and approximately the same distance back as source alpha 128. Because of its off axis orientation in reference to the window, its wave pattern intersects the window at an angle. Beta 130's frequency content is of medium relative frequency. Source gamma 132 is to the right of center for window 134, but is farther back relative to the other sources. Frequency content of gamma 132 represents the lowest of the three audio sources illustrated. Note that in all cases, at some point within the audio window, each audio source has corresponding wave patterns that impinge at angles other than "face on" to window 134. The physical size of audio window 134 is determined by the particular application. Dimensions can vary from an area as small as 0.3 meters square, that of a moderate sized picture frame, to an area covering a large cinema screen, or even larger.

FIG. 15 shows the same three audio sources from a horizontal view, looking at the front of window 134. FIG. 15 more clearly illustrates the wave pattern impinging on window 134 in correspondence with the audio sources alpha 128, beta 130, and gamma 132. The wave pattern is still schematized, indicating only relative positions of the waves at a particular phase, such as its peak. FIG. 16 shows an isometric 3-dimensional view of sources alpha 128, beta 130, and gamma 132 without their corresponding wave patterns. FIG. 16 best illustrates the three dimentional placement of each source in reference to each other, as well as to window 134.

Figure 17:
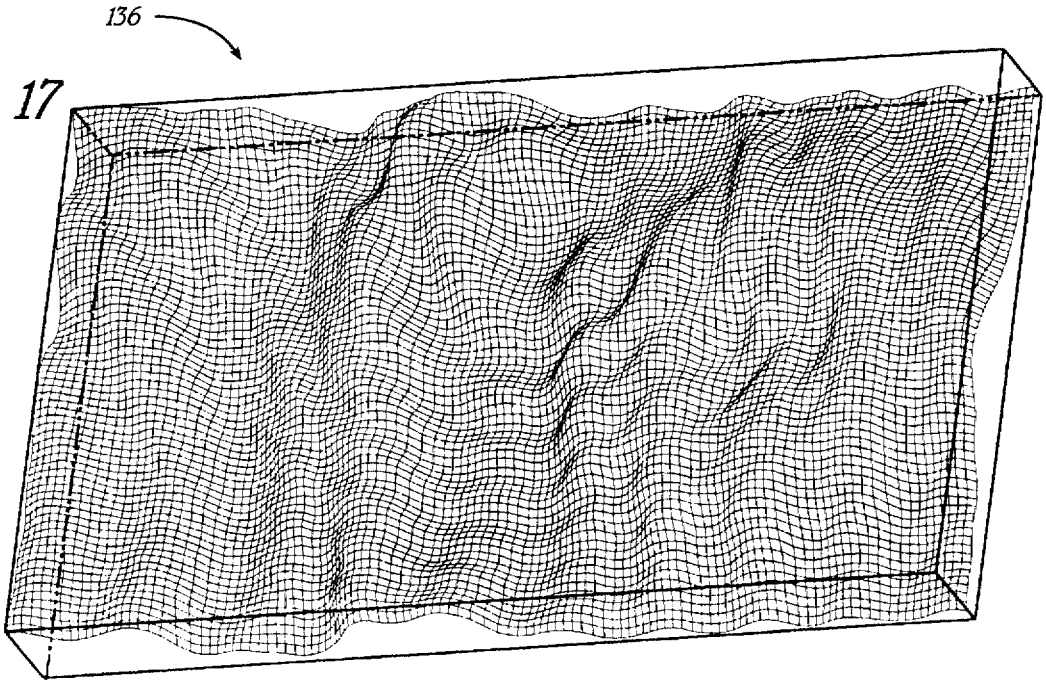
FIG. 17: An aerogel speaker window actual topographical displacement pattern of directly driven aerogel diaphragm (exaggerated, not to scale)
Figure 18:
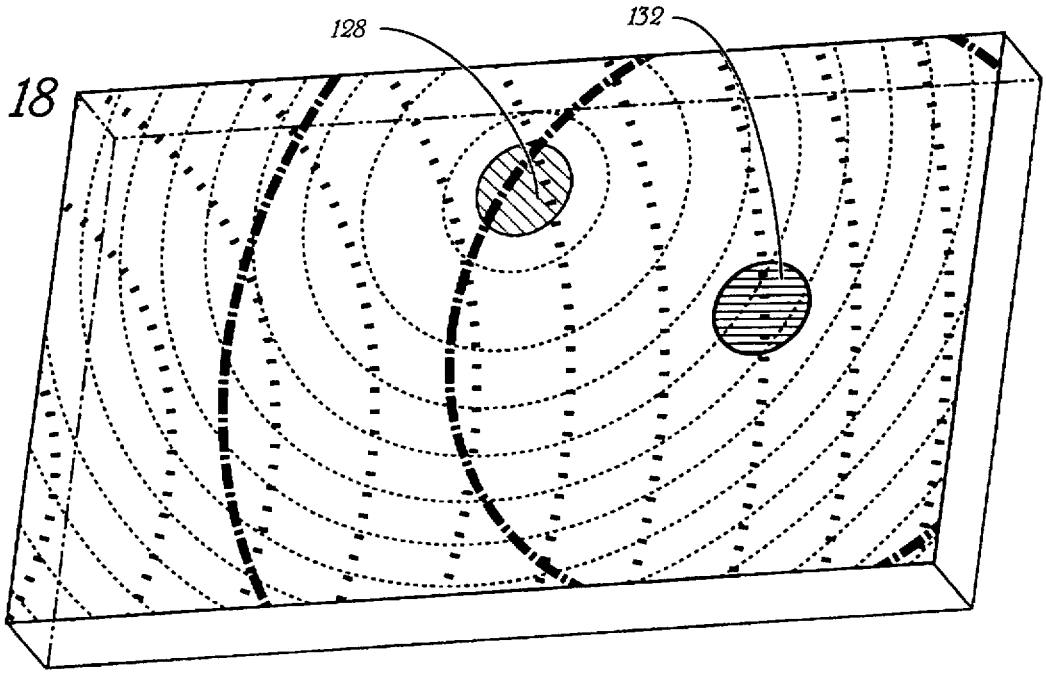
FIG. 18: An aerogel speaker window schematic representation of complex audio dispersion pattern, angled view List of Reference Numbers

FIG. 18 is an enlarged view of window 134 as schematically illustrated in FIG. 15, but seen in an isometric view slanted up and tilted to the left. The wave patterns impinging upon window 134 emanate from audio sources illustrated in FIGS. 14, 15, and 16. Audio source 130 is not visible because of its off-axis location, although its audio information is still apparent on audio window 134. In FIG. 17, a topological representation 136 of the schematized wave patterns in FIG. 18 attempts to fill in the information missing in the schematized illustrations. Topological representation 136 illustrates mixing of wave information across audio window 134, not only at the peaks, but points in between as well. Representation 136 also serves as an illustration of an actual complex displacement pattern of an aerogel diaphragm frozen in time. The terrain, exaggerated in amplitude, represents an aerogel diaphragm being directly driven by means of a complex array, such as that described in FIGS. 6 and 7. Such an array would be capable of reproducing a complex acoustic wave pattern similar to a pattern that might be projected through an actual open window. This modulated pattern in real time would act as three dimensional audio or acoustic information passing through to the listener.

THEORY OF OPERATION

This invention relies heavily on the unique nature and inherent properties of aerogel type materials. Although the basic process of aerogel fabrication has been known since the early 1930's, and first described in a patent by S. S. Kistler (U.S. Pat. No. 2,249,767), and although their method of fabrication is well understood, it has only been recently that interest in these unique material has been rekindled, primarily due the need for strong lightweight materials in the space and aeronautic industries, as well as applications in particle physics. Also, improvements in manufacturing techniques such as U.S. Pat. Nos. 5,409,683 (Tillotson et al), 5,294,480 (Mielke et al) and others have made it a more attractive material for potential commercial use. Still, to a large extent aerogels have been a material looking for an application.

Xerogels, or aerogels are sol-gels in which the liquid portion of the gel has been evaporated off from the solid at supercritical pressures and temperature to leave an underlying microstructure composed of minute spherical particles on the order of nanometers. These particles link to form a colloidal lattice resembling a complex 3-dimensional web with large open spaces between, resulting in a highly porous bulk volume and extremely large effective surface area to volume and mass ratios. The resulting materials manifest attributes of extremely low densities, as low as 0.05 gm/cm$^3$ or less, in combination with significant mechanical strength. Structure, shape, density and composition are all highly controllable so that a diaphragm manufactured from an aerogel could have characteristics tailor made to a particular speakers design.

Two principle benefits are afforded by the use of aerogel in the fabrication of a diaphragm for a speaker. First, because of an aerogel's fine porous structure and ultra lightweight, with densities approaching that of ambient air, a diaphragm fabricated from such material would exhibit a very low inertia and result in a superior acoustical impedance match. This greatly improves efficiency, performance, and extends the range of frequency response of the transducer. Secondly, because the bulk volume of the aerogel can be fabricated with materials that electromagnetically or electrostatically couple throughout the volume of the aerogel to the electromagnetic or electrostatic drive fields, there is no need for an intermediary structural conveyance to redistribute drive energy. Every portion of the aerogel volume is evenly and independently driven throughout. This makes overall mass considerations much less relevant. Relative densities of the aerogel, field permeability of the aerogel material, shape of the diaphragm as well as the overall strength and shape of the drive field itself, all become factors in transducer performance. These materials can consist of ferrous or magnetic compounds that are either magnetic in and of themselves or magnetically permeable. They can also be made of conductive materials to create electrostatic fields throughout the volume of the diaphragm, not just at it's surface. Or the conductive materials can be made to carry current to induce electromagnetic fields throughout the bulk volume of the diaphragm.

One other important characteristic of aerogel as described in U.S. Pat. No. 5,306,555 (Ramamurthi et al) is the ability of combining it with other materials to form composite type structures. Composites of aerogel and magnetic materials can be used to improve inductance and reactance characteristics. A diaphragm can be manufactured with embedded conductors for enhanced field strength. Fiber re-enforcement or a web lattice such as a spider web type structure can give the aerogel added strength and flexibility. A combination of embedded conductors and magnetically inductive material in an aerogel composite can be used for enhanced field distribution and inductance loading throughout the aerogel diaphragm. Although the non-aerogel substances used as part of the aerogel composite are typically of much greater density than that of the aerogel portion of the composite, it is the average overall volume density that is of principle concern in determining performance characteristics of an aerogel diaphragm.

While an acoustic transducer with an aerogel diaphragm can be made to operate in the same linear fashion as a conventional acoustic transducer, because the aerogel bulk volume itself is directly driven, it is possible to drive any portion of an aerogel diaphragm substantially independently and in opposition to any neighboring portion of the same diaphragm. This unique ability would allow an aerogel diaphragm to be modulated in a way that would create a complex wave patterns, much like an acoustic window. The complexity of the wave pattern would be limited only by the compliance of the diaphragm. Because the aerogel can be molded to complex patterns, shapes and configurations, a diaphragm of sufficient compliance is possible to create an audio window with an acoustic image several magnitudes larger than the window dimensions itself. To our knowledge, no other configuration in the way of an audio acoustic transducer or speaker exists with the same capabilities.

OPERATION OF INVENTION

In its most fundamental embodiment, this invention describes an audio acoustic transducer using an aerogel diaphragm that, in the case of an output device, is directly driven by either electromagnetic means or electrostatic means, and in the case of an input device, the aerogel diaphragm directly affects a pickup designed to detect electromagnetic or electrostatic variations.

In one embodiment, FIG. 1 depicts a basic electromagnetic aerogel speaker. The aerogel diaphragm 20 would be fabricated from ferrous or magnetic or magnetically permeable aerogel or aerogel composites with similar magnetic reactance characteristics. Diaphragm 20 is magnetically neutral, acting as an electromagnetic load to focus the oscillating electromagnetic field 28 back on to the inductive core spindle 24. Diaphragm 20, in an effort to follow the changing field lines passing through its volume, is made to move in sympathy to electromagnetic field 28. Diaphragm 20 can also be permanently magnetized with fixed moment and field of its own. In this case, diaphragm 20 would be made to move as its own permanent field reacts to changes in polarity and strength of electromagnetic field 28. In either case, diaphragm 20 would contain sufficient inductive content to adequately load electromagnetic field 28 created by electromagnetic drive coil 22. Drive coil 22 is wound to inductively match the combined inductive load of all elements of the acoustic transducer so as to provide the desired electrical impedance, field strength, and frequency response for a given transducer. Spindle 24 attached to fixed base 26 are all made of ferrous or similar magnetically reactive material. The magnetic content should be of sufficient inductive reactance to focus electromagnetic field 28 towards diaphragm 20, but still low enough reactance to allow for maximum frequency response. Diaphragm 20 is suspended in proximity to drive coil 22, spindle 24, and fixed base 26. Means of suspension can include a thin suspension ring fabricated from a light flexible plastic, a thin corrugated edge molded into diaphragm 20 itself, suspension filaments, or electromagnetic suspension alone. It is only necessary for diaphragm 20 to have sufficient freedom and compliance for adequate displacement and frequency response.

In another basic embodiment using electrostatic means, FIG. 2 depicts aerogel diaphragm 44 fabricated from a conductive aerogel such as a carbon aerogel or other conductive aerogels. Diaphragm 44 is physically position in close proximity between two fixed electrostatic driver grids 42*a* and 42*b*, with a small air gap between. The grids do not electrically touch the diaphragm. The high DC grid bias voltage 38 with a potential ranging from 1,000 to 7,000 volts is applied to grids 42*a* and 42*b*, with one potential polarity going to 42*a* and the other potential polarity going to 42*b*. The orientation of a particular polarity to a particular grid is not important. The air gap between diaphragm 44 and grids 42*a* and 42*b* is proportionate to the bias voltage 38, typically 0.001 inches for every 100 volts. The amplitude of bias voltage 38 is dependent on the grid to diaphragm spacing, grid design, as well as the combined surface area of the diaphragm and grids. Bias voltage 38 is derived from the high voltage DC power supply 36. Although the voltage is of significant magnitude to create a strong electrostatic field between drive grids 42*a*, 42*b*, the current required to maintain the charge is small, on the order of 20 to 40 microamps, enough to maintain constant field strength. Diaphragm 44 is electrostatically driven by high voltage audio signal 40 in the presence of the electrostatic fields emanating from grids 42*a* and 42*b*. As the field's potential around diaphragm 44 changes from negative to positive and back again, diaphragm 44 is repelled by the grid of like charge, and attracted to the grid of opposite charge, with a force corresponding to electrostatic potentials between diaphragm 44, and grids 42*a* and 42*b*. The high voltage audio signal 40 is derived from voltage step-up transformer 34. Transformer 34 is driven by an audio signal (not shown), preferably from a typical audio amplifier. The electrostatic field driving diaphragm 44 is imparted evenly throughout the bulk volume of the aerogel, thereby imparting electrostatic forces evenly throughout the diaphragm medium. Because diaphragm 44 is of a certain bulk thickness, planar distortion is reduced. As a result, the diaphragm exhibits better excursion characteristics with less inner-resonate distortion.

FIG. 3 depicts a third basic embodiment consisting of embedded conductors 48 within the aerogel diaphragm 46 in a vertical/parallel configuration. Modulated electromagnetic fields emanate from embedded conductors 48 in direct proportion to the drive current from audio amplifier 52. Amplifier 52 functions as a current amplifier for line level audio input 54. If diaphragm 46 is formed from magnetically permeable aerogel or magnetically permeable aerogel composites, then the modulated electromagnetic fields emanating from embedded conductors 48 are distributed and focused more evenly throughout diaphragm 46 by means of the magnetically permeable content of the diaphragm. The distribution of the modulated electromagnetic field is dependent on the permeability of diaphragm 46, the strength of the modulated field as determined by amplifier 52, the physical spacing of conductors 48 within diaphragm 46, and the electrical impedance of conductors 48. Diaphragm 46 and its modulated field are made to react with the magnetic field emanating from the fixed permanent magnetic backplate 50, causing diaphragm 46 to physically modulate in proportion to the drive signal from amplifier 52. Permanent magnetic backplate 50 can be a large planar shaped permanent magnet with one pole emanating out of the top plane, and the other emanating out of the bottom. The stronger the fixed magnetic field emanating from permanent magnetic backplate 50, the more efficient the speaker operates. Alternatively, permanent magnetic backplate 50 can be composed of individual strip magnets running parallel to conductors 48. An alternate embodiment of FIG. 3 is diaphragm 46 being formed from non-magnetic materials with an increased number, or length, or combination thereof, of embedded conductors 48. This would increase the effective field strength of conductors 48, as well as provide for a more uniform field pattern. Although a somewhat higher local density within the diaphragm might be expected from this configuration due to the added conductor bulk, lighter aerogels such as SiO aerogels could be used to compensate for the added mass resulting in an overall low density.

FIG. 4, a speaker, is an elaborated embodiment of FIG. 1. The aerogel diaphragm 66 is made of either ferrous or magnetic or magnetically permeable aerogel or aerogel composite with similar magnetic reactance characteristics. The aerogel diaphragm 66 is electromagnetically driven by the electromagnetic drive coil 56 attached to a combination core spindle 58 and backplate 60 via the core spindle 58. Spindle 58 and backplate 60 are composed of a magnetically inductive or permeable material such as a ferrous compound or ferrous/plastic composite, and provide means for directing and focusing the electromagnetic field created by coil 56. Magnetic field lines generated by electrically modulated coil 56 are directed through the center of spindle 58, with one pole emanating out the top center of the spindle, the opposite pole emanating out the bottom center of the spindle. The lines emanating out the bottom of spindle 58 are directed to radiate radially from the center of the backplate 360° evenly outward to the sides of the backplate 60. The field lines emanating from the sides of the backplate 60 return to close the loop at the top of the core spindle 58, thus creating a torus or donut shaped field centered around spindle 58 and coil 56. The polarity and strength of the electromagnetic field created by coil 56 is dependent upon the amplitude and polarity of the modulating current. Magnetic field focusing ring 64 further aids in shaping the electromagnetic field, as well as serving as a mechanical interface between core 58, backplate 60, and diaphragm 66. Backplate 60 fits into lower inside diameter 68 of ring 64. Diaphragm 66 fits into upper inside diameter 70 of ring 64. The composition of ring 64 is of similar or the same material as core 58 and backplate 60. The combined core 58, backplate 60, ring 64, and diaphragm 66 are of a sufficient inductive reactance to adequately load coil 56, but not excessively enough to limit the upper frequency response. Coil 56 electromagnetically couples directly to the material within diaphragm 66. This physically modulate diaphragm 66 as a whole unit, in proportion to the electrical audio signal (not shown) driving coil 56, resulting in audio acoustic sound. Although FIG. 4 and FIG. 5 depict diaphragm 66 as having a basic disc shape of uniform thickness, the diaphragm could be molded into varying cross-sectional contours, including a thin corrugated area at the outer edge for use as a flexible support ring built into the diaphragm to allow for adequate diaphragm excursion. Another modification to the aerogel diaphragm would be to vary the thickness from the center of the diaphragm outward, with the thinnest portion being located in the center. This would allow the higher frequency to also emanate from the center of diaphragm 66, thereby allowing thickness to control frequency response. This configuration assumes that the outer edge of the aerogel diaphragm is substantially anchored to ring 64, thereby dampening frequency response at the outer edges of the diaphragm. Only the lowest frequencies would have sufficient drive and leverage to move the outer edge of the aerogel diaphragm. Acoustic vent holes 62 in backplate 60 allow for pressure equalization of the interior of the speaker unit. This helps to provide better efficiency and controls the frequency response by lowering the internal acoustic impedance of the speaker. To prevent low frequency loss, the speaker should be mounted in a cabinet or other appropriate acoustic chamber (not shown), much the same as in conventional speakers, to prevent low frequency "wrap-around" of the longer wavelengths. One speaker element employing an aerogel diaphragm as illustrated in FIG. 4 and FIG. 5 would be sufficient to reproduce the full spectrum of frequencies required for hi-fidelity listening. FIG. 5, a single driver ferrous aerogel speaker, is an external view of FIG. 4.

FIG. 6 and FIG. 7 represent embodiment of a hexagonal electromagnetic driver array ferrous aerogel speaker. FIG. 7 depicts an external view of FIG. 6. In an exploded view of FIG. 7, FIG. 6 shows electromagnetic drive coil array 72 with individual electromagnetic drive coils 74 similar to element 56 in FIG. 4, arranged in a hexagonal pattern, based upon an equilateral triangle. The reason for the hexagon pattern is twofold. First, the basic pattern can easily be extended and repeated in any direction, allowing for a speaker panel of any height or width dimension required, only the equilateral placement of the individual drive coils 74 in reference to each other must be maintained. Secondly, the hexagonal pattern provides an easy and relatively inexpensive means to generate complex electromagnetic field terrains, the use of which will be described below in detail. The nature of magnetic fields is such that any single arbitrary field line is prohibited from cutting through any other field line, no matter what the strength or size of a given field. The result is that one field emanating from one driver coil can push, compress, and otherwise influence the shape of a field or fields of its neighboring drive coil, and visa-versa.

With the exception of the number of drivers, FIG. 6 depicts components with similar characteristics and functions with those of FIG. 4. Electromagnetic drive coil array 72 composed of individual electromagnetic drive coils similar to electromagnetic drive coil 74 is attached to the spindle core array 76 which is composed of individual core spindles similar to core spindle 78. Spindle array 76 is attached to backplate 80 with acoustic vent holes 86 similar to holes 60 in FIG. 4 and for similar purposes. The magnetic field focusing ring 82 is similar in nature to ring 64 in FIG. 4, but is hexagonal in shape. Ring 82 aids in directing and focusing the electromagnetic field emanating from backplate 80 through ring 82 into diaphragm 84, while also serving as the physical means to hold diaphragm 84 in proximity with coil array 72 and spindle array 76.

Backplate 80 fits into lower inside diameter 88 of ring 82. Diaphragm 84 fits into upper inside diameter 90 of ring 82. Diaphragm 84 is a composition of ferrous or magnetic or magnetically permeable aerogel or aerogel composite with similar magnetic reactance characteristics. With drive coil array 72 driven according to a Bessel function as described in "Sound System Engineering" (Snd Ed., by D. Davis & C. Davis, Pub. H. W. Sams & Co. Indianapolis, Ind., p. 327–330), the aerogel diaphragm can be constructed with characteristics similar to diaphragm 66 in FIG. 4. In the case of the array being driven in a phase modulated mode, or complex modulated mode, diaphragm 84 is designed for maximum divergent displacement. In other words, a diaphragm would be fabricated to have the ability to contort substantially across a plane in a way that would allow for the maximum amplitude peak-to-trough displacement, combined with the minimum wavelength possible. The limits of these characteristics will determine the overall performance of the diaphragm. In reality, amplitude displacement requirements on the diaphragm in the upper frequencies are far less demanding. The wavelength of a 10 KHz acoustic sine wave at 1 atmosphere is approximately 4 cm. From peak-to-trough the distance would be one half of the wavelength, or 2 cm. Therefore, the maximum amplitude possible from a diaphragm for an emulated 10 KHz sine wave at 1 atm. would be determined by the maximum amount of divergence possible for a diaphragm within 2 of a centimeter. For a 10 KHz sine wave, a physical divergence of approximately $2.19\times10^{-5}$ cms would achieve an acoustic output of $3.08\times10^{-5}$ acoustic watts per $cm^2$. This divergence is equivalent to a 115 dB Signal Pressure Level in reference to 20μ Pascals threshold of hearing.

In a phase modulated mode, each individual coil 74 in coil array 72 is passively linked to its nearest neighbors through a simple inductance-capacitance circuit. The LC time constant is chosen to reflect the period of time required for a wave front to transverse the distance between one coil 74 and its neighbor, or one spindle 78 and its neighbor. An electrical audio drive signal (not shown) is fed to any one coil 74, and from there, the drive signal is disseminated throughout the array through each LC bridge, driving each coil 74 in succession with a phase delay across diaphragm 84 matched to the velocity of the wave front. For added precision, the LC circuits could be designed with a mechanical or electrical means to adjust the capacitance or inductance of each LC circuit in unison to match minor variations in air speed due to pressure and humidity changes, or simply as an effect.

In a complex modulation mode, aerogel diaphragm 84 requirements are similar to those of the phase modulated mode, with the new mode of modulation effectively turning the speaker illustrated in FIG. 6 and FIG. 7 into an "acoustic window". With the aid of FIGS. 14, 15, 16, 17 and 18, the inventors will attempt to illustrate the concept and embodiment thereof.

Consider an arbitrary audio source, and allow that audio source to radiate a simple sine wave at a constant frequency in a spherical pattern with pressure peaks and rarefications occurring at regular intervals out from the center of the audio source, much like layers of an onion. FIG. 14 represents an overhead view of three arbitrary audio sources, their relative placement, and their corresponding wave patterns, audio source alpha 128, audio source beta 130, and audio source gamma 132. Each source is emitting a wave pattern of different frequency with alpha 128 representing the highest frequency, beta 130 a mid frequency, and gamma 132 the lowest of the group. A narrow rectangle at the bottom of FIG. 14 represents the position of the "audio window" 134 as seen from above in reference to the audio sources. FIG. 15 depicts a front view of the same audio window 134 with the same audio sources alpha 128, beta 130, and gamma 132, now from a horizontal view. Note that in both FIG. 14 and FIG. 15 that audio source beta 130 is significantly off-center to the left of audio window 134.

FIG. 16 depicts a 3-dimensional view of FIG. 14 and FIG. 15 with spatial placement of all three sound sources in reference to each other and audio window 134, but without the clutter of the corresponding wave patterns. Audio window 134 as seen in FIG. 15 illustrate the interaction of all three sound sources at the point of intersection of audio window 134's plane, similar to slicing through a cross-section of an onion. The ring pattern can only represent the peak of the wave patterns, and it is assumed that each waves trough is somewhere between, and a smoothly varying gradient of pressures distributed between the seen peaks and unseen troughs. It is much more difficult to illustrate the interplay between the waves. In FIG. 14, it can be seen that, for each wavefront intersecting audio window 134, the angle of intersect is different for each wave, complicating the pattern even further. Where the wavefronts intersect squarely on, perpendicular to the window, the diaphragm is similar to a conventional speaker with only two directions of movement, back and forth. But as the wavefront moves out across the audio window 134, individual crests and troughs begin to emerge for each wavefront, until in extreme cases such as beta 130, audio window 134 is forced to create crests and troughs in the diaphragm, with distances between being determined by the wavelength of the particular audio source. FIG. 16 is a computer generated topological map of the complex contours that represent the wave patterns of the audio window 134 as illustrated in FIG. 14 and FIG. 15. An enlarged 3-dimensional view of FIG. 14 and FIG. 15 in direct correspondence with FIG. 16 is illustrated in FIG. 17. The basic wave patterns were assumed to be sinusoidal in nature, and the overall amplitude of the waves have been greatly exaggerated to accent their complex interaction. It is this complex interaction that defines the nature of an audio window, and it is the complex array driver in FIG. 6 and FIG. 7 combined with the directly driven aerogel diaphragm 84 that makes this unique mode of audio reproduction possible.

As stated above, the ability for the aerogel diaphragm 84 in FIG. 6 to emulate these complex displacement modulations will determine the overall performance of the hexagonal array in FIG. 6 and FIG. 7 as an audio window 134, with the upper frequency response of the diaphragm determining the extent of off-axis transmission. With the low to mid-frequencies, it is possible to create off-axis emanations that acoustically appear to be several times the width of audio window 134, the larger the window, the greater the multiple. For very large audio windows 134, the off-axis emanations approach the infinite. For higher frequencies, the off-axis emanations are limited to two to three times the width of the audio window 134, depending on size of speaker array and diaphragm 84 and frequency. It should be apparent, not only can a listener's point of reference be in front of audio window 134, listening "through" to the other side. Alternatively, a wave pattern created on audio window 134 is capable of projecting virtual audio objects that psychoacoustically appear to emanate from "in front of" audio window 134, as if the audio sources 128, 130, and 132 were in front of audio window 134. For best results, audio window 134 would need to be larger than the audio image being projected in front. The size of the window would limit the acoustic image size as well as the apparent distance in front of the window. The virtual image would be created by wave patterns projected from audio window 134 diverging in front of the window. A listener would perceive the audio image at the point of divergence.

One more important group of embodiments of an audio transducer with an aerogel diaphragms are centered around the transducer as an input device.

FIG. 8 and FIG. 9 illustrates the internal components belonging to an embodiment of a basic electrostatic or condenser type microphone with a conductive aerogel diaphragm serving as the acoustic interface.

FIG. 8 is a close-up cut away view of the microphone condenser elements. Conductive aerogel diaphragm 92 contained in electrically conductive frame 96 is held in close proximity to fixed conductive bookplate 98. Backplate 98 is held by conductive backplate frame 102. Acoustic vent holes 100 are perforated into backplate 98. Bias voltage 104 with a potential of 1.5 to 50 volts is directly applied to diaphragm 92 and indirectly to backplate 98 through resistor 106. Diaphragm 92 and backplate 98 effectively create the capacitor portion of a capacitor/resistor network. Resistor 106 has a nominal value between 1 Megohms to 10 Megohms, depending on the effective capacitance of diaphragm 92 and backplate 98, as well as the required frequency response and sensitivity of the microphone design. Because diaphragm 92 is allow to physically move in reference to backplate 98, capacitance is varied in direct proportion to the impinging acoustic energy. Change in capacitances results in a temporary change in voltage potential, in proportion to the acoustic energy. The resulting differential in voltage is used as an audio output signal 108. Because of the extremely low inertia of diaphragm 92 in comparison to a conventional diaphragm, higher frequency response, lower overall distortion, and greater sensitivity are all possible in a microphone of this type.

In FIG. 10 an embodiment of a dynamic type microphone is illustrated using electromagnetic fields to create an electric current in a pickup coil proportional to an acoustic signal. A cylindrical shaped magnetic aerogel diaphragm 118 is composed of ferrous or magnetic material or a magnetic composite and imparted with a permanent magnetic field with a pole at each face of the diaphragm cylinder. Diaphragm 118 is held in place but allowed a degree of freedom by diaphragm suspension 122 connected to aerogel frame 120. Frame 120 is in turn mounded to the upper edge of the inside diameter of mounting ring 112. Magnetic pickup coil 124 is mounted to the lower edge of the inside diameter of the mounting ring 112. Pickup coil 124 wraps around the circumference of diaphragm 118 with just enough clearance to avoid binding. Any physical movement of diaphragm 118 caused by acoustic energy impinging on its surface will cause the magnetic field emanating from diaphragm 118 to move through pickup coil 124. This induces an electric current within pickup coil 124 which can be used as an electrical audio signal. Mounting ring 112 supports upper protective audio screen 114 and interfaces with lower protective audio screen 126, which in turn is mounted to microphone body 116.

FIG. 12 and FIG. 13 depicts another embodiment of a dynamic microphone, using an embedded conductor.

In FIG. 12, a disc shaped aerogel diaphragm 138 with embedded spiral conductor 140 is held in place by diaphragm suspension ring 142 in proximity to cylindrical shaped permanent magnet 146. Diaphragm 138 can be made of a non-magnetic aerogel material preferably of ultra light density such as a aerogel material with a minimal thickness adequate to suspend conductor 140. Conductor 140 is preferably made of ultra thin conductor wire such as copper or gold wire. If a non-conductive aerogel is used, then conductor 140 need not be insulated, so long as care is taken to spatially separate the windings. Permanent magnet 146 is magnetically oriented with north pole 148 and south pole 150 emanating at opposite faces of permanent magnet 146. As diaphragm 138 is caused to move through the magnetic field created by permanent magnet 146 by impinging acoustic energy, an electrical current is created within the conductor 140 resulting in audio output signal 144.

FIG. 13 depicts the elements of FIG. 12 mounted in a microphone assembly similar to FIG. 10, and FIG. 9, where the elements are held by mounting ring 112. Diaphragm suspension ring 142 is mounted in the upper inside diameter of mounting ring 112. Permanent magnet suspension ring 152 holding permanent magnet 146 is placed in the lower diameter of mounting ring 112. Again, mounting ring 112 interfaces with upper protective audio screen 114, and lower protective audio screen 126. Lower protective audio screen is mounted to microphone body 116.

FIG. 11 is an exterior illustration of the basic aerogel microphone, with mounting ring 112 interfacing with audio screen 114, and 126. Screen 126 is mounted to microphone body 116. Other aerogel diaphragms type microphone designs are possible using the same basic principles presented herein, designed to meet the requirements of the user.

CONCLUSION, RAMIFICATIONS AND SCOPE OF INVENTION

From the description of the above invention and its embodiments, one can see that the application of an aerogel diaphragm in an audio transducer, either as an input device or an output device, is a substantial and innovative improvement over conventional speaker, microphone, or audio acoustic transducers. It directly addresses two fundamental problems involved in speaker or microphone design, the problems of energy transference and impedance matching. This is done through the application of one family of materials, in conjunction with the use of electromagnetic and electrostatic fields as the drive means. The use of aerogel materials as a diaphragm allows for an exceptional impedance match with ambient air, with some aerogels having densities only 5 times that of air at 1 atmosphere pressure, in comparison to an equivalent solid diaphragm having densities 1,000 times or greater. This quality significantly improves efficiency of the transducer while widening the range of frequency response, allowing for a single element loudspeaker to completely reproduce the listening audio spectrum range at a respectable amplitude. Because the aerogel is a bulk volume material, and because that material can be fabricated from substances that can directly couple to the drive forces, an aerogel diaphragm can be uniformly driven throughout the volume of the diaphragm, avoiding the problems of mechanical drive stresses inherent in conventional speakers and microphones. The use of aerogels and aerogel composites as a directly driven diaphragm allows for an improved acoustic transducer that is pioneering in nature, economical to produce, and a significant advancement in performance.

The aerogel diaphragm material also affords design options that would either be difficult or impossible to implement with conventional speaker and microphone materials and design techniques. The audio window described in FIGS. 14–18 detailed above is one example.

When the bulk volume of the aerogel serves as a suspension medium for conductors, then the need for field-reactive substances within the aerogel becomes optional, and drive fields created by the conductors are limited only by the current carrying capability of the conductors within. The 3-dimensional lattice of the bulk aerogel serves as the transfer structure for distributing the drive energy generated by the conductors to the bulk volume of the aerogel diaphragm. This also allows for design shapes and configurations not possible in conventional speaker and microphone design.

Other possible embodiments are:

A deep throw piston type aerogel diaphragm, where the piston diaphragm is suspend as well as directly driven by a series of electromagnetic coils both in the diaphragm as well as in the containment cylinder. The series of electromagnetic coils would act much like a linear motor magnetic array, causing the piston diaphragm to move forward and backwards within the cylinder for a linear displacement limited only by the length of the cylinder and number of individual coils within the array.

An electromagnetic speaker with a drive coil around the perimeter of a magnetically permeable aerogel diaphragm disc, and with a number of thin horseshoe shaped focusing vanes also around the perimeter of the drive coil, all facing and extending inward toward the center, providing for a uniform electromagnetic drive field above and below the aerogel diaphragm.

An electrostatic aerogel microphone with a receiving pattern in the form of a 360° sphere, and with a full spectrum audio response. Furthermore, the microphone would output a signal that provides directional information. A hollow conductive aerogel sphere would serve as a diaphragm with an internal conductive spherical backplate, the backplate being electrically zoned to reflect an X/Y/Z configuration. As audio impinges on any one portion of the spherical aerogel diaphragm, the acoustic force would modulate the sphere with the audio signal while deflecting the sphere towards a preferred zone based upon the direction of the audio signal. The signals derived from the different zones would be summed and differentiated through a series of differential amplifiers to reflect the X/Y/Z directional orientation of the received acoustic signal.

A reversal of the above 360° microphone with a small lightweight aerogel pickup in the form of a self supporting thin rod anchored at one end, with an acoustically transparent conductive screen surrounding the rod element serving as the backplate. Because of the rod shape, its response characteristics would be much like a ribbon microphone, but because it is a self supporting element and substantially free at one end, it would be free to modulate with a much greater displacement than a conventional pickup element. This configuration would allow for greater sensitivity, a 360° column type response pattern, and a greater dynamic range.

Other microphones with complex dimensional pickups could be designed for a variety of uses, limited only by the attributes required by the microphone. Microphones of specific pattern and frequency response could be made with the aerogel diaphragms specifically shaped and molded for that purpose.

Although FIG. 3 depicts embedded conductors 48 driven in a parallel configuration, other configurations are possible. One alternative would be for each vertically embedded conductor to be independently driven in a variety of modes, including but not limited to a phase related mode, or a mode based on a Bessel array. The embedded conductors could also be arranged in other configurations, similar but not limited to; a spiral pattern, a zig-zag pattern, a grid pattern, or a combination thereof. The overall pattern would depend on the size, shape and composition of the aerogel diaphragm, as well as the overall design criterion of the audio transducer or speaker. Of course, the design of the permanent magnetic field employed as a reactance field in reference to the aerogel diaphragm would need to be configured to correspond to the pattern of the embedded conductors.

Design of an aerogel diaphragm could incorporate a means to electromagnetically stretch and suspend the diaphragm by the use of a permanent magnetic edge or embedded conductor around the perimeter of the aerogel diaphragm, with a corresponding electromagnetic coil around the frame of the speaker. The electromagnetic coil would be connected to a circuit that would drive the coil used to suspend the diaphragm. The same circuit would have a feedback mechanism which would monitor the tension and placement of the aerogel diaphragm within the frame. This would allow for a diaphragm literally suspended in air.

A special application and embodiment of the audio window using an aerogel diaphragm is suggested in the following. An audio window is constructed as an input device, with the aerogel diaphragm affecting the driver array as a whole, imparting a unique signal to each drive coil within the array. The overall dimensions would be typically a 1.0 m by 1.3 m panel, or dimensions approximate thereto. The panel would be placed in relative close proximity to an audio source such as an instrumentalist playing an acoustic guitar, approximately 1 meter away, facing the instrumentalist and instrument. The panel would act as the "listener". A significantly larger audio window speaker panel would serve as the output device, with as much as a 5 to 10 fold increase in size. Each element of the array in the larger panel would be driven by the corresponding element in the smaller input panel, with each output element being amplified in the same proportion. The resulting effect would be an enlarged acoustic image across the output panel with the same psycho-acoustic information that a listener would derive from sitting directly in front of the instrumentalist, but now enjoyed by a theatrical sized audience, without the smearing of the audio image experienced by a more conventional array of concert speakers.

An even more elaborate extension of the audio window would be to panel a small to mid-size room completely, including floor and ceiling, with the electromagnetic arrays described in FIG. 6. The floor would be suspended, and have acoustic vents to allow sound to pass through to the audio window below. The complete paneling would effectively create active areas on all surfaces of the room. If the panels are used for input devices as well as an output device, then with the aid of parallel processing from a network of computers or a neural network and software algorithms similar to graphic "ray tracing" techniques, a type of virtual acoustic room would be created. The room would be able to emulate the acoustics of any room imaginable. Acoustic energy originating within the room would reach the audio window at different arbitrary points on the window's surface. The computer circuitry would analysis the nature and point of contact with the window and if needed, would cause the audio window to produce an out-of-phase acoustic wave to cancel the original acoustic wave. Then according to the parameters programmed for the virtual room being emulated, the network would introduce a virtual acoustic reflection of the originally dampened waveform onto the appropriate portion of audio window at the appropriate time with the appropriate amplitude and frequency range.

While the above descriptions contains many specificities, these should not be construed as limitations on the scope of the invention, but rather as an exemplification of the preferred embodiments thereof, the spirit and scope of the present invention being limited solely by the appended claims.

We claim:

1. An acoustic transducer that converts between electrical energy and acoustic energy comprising:

a) an aerogel diaphragm formed from materials selected from the group consisting of aerogels, aerogel composites, magnetically inductive and magnetically permeable aerogels, and magnetically inductive and magnetically permeable aerogel composites, said aerogel diaphragm having at least one surface used as an acoustical interface, b) a magnetic field created by magnetic sources selected from the group consisting of permanent magnets and electromagnets, c) at least one electrical conductor embedded within the sum and substance of said aerogel diaphragm and a means for electrical interface to said conductor, said conductor being integral to said sum and substance of said aerogel diaphragm, d) said magnetic field being placed in close proximity to said electrical conductor embedded within said aerogel diaphragm, and said electrical conductor being configured to provide means for electromagnetic coupling to said magnetic field, thereby enabling interaction between said magnetic field and said aerogel diaphragm in correspondence with physical movement of said aerogel diaphragm.

2. A method of converting an acoustic signal to an electrical signal by an acoustic transducer comprising the steps of:

a) an aerogel diaphragm formed from material selected from the group consisting of aerogel and aerogel composites, and having at least one surface for acoustical interface, is induced to physically modulate in correspondence with an acoustic signal, b) at least one conductor is embedded substantially within the bulk volume of said aerogel diaphragm, said conductor being integral to said bulk volume of said aerogel diaphragm, providing a direct correspondence of movement between said aerogel diaphragm and said conductor, thereby modulating said embedded conductor in correspondence with said acoustic signal, said conductor also being configured to provide for an electrical field pickup or electrical field sensor or electrical field transducer means to generate an electrical signal in proportion to a change in strength of an electrical field, c) said embedded conductor within said aerogel diaphragm is placed substantially in the presence of a permanent electrical field selected from the group consisting of magnetic fields and electrostatic fields, said permanent electrical field being held spatially constant in reference to said aerogel diaphragm and said embedded conductor within said aerogel diaphragm, d) said acoustic signal physically modulates said embedded conductor within said aerogel diaphragm, causing said embedded conductor to spatially change position in reference to said permanent electrical field, thereby creating an apparent change in strength of field within said embedded conductor, said embedded conductor acting as said electrical pickup, thereby registers said change in strength of field as an electrical output signal in direct proportion to said acoustic signal.

3. A method of converting an acoustic signal to an electrical signal by an aerogel diaphragm and transducer in claim 2 wherein:

a) said aerogel diaphragm is fabricated with said embedded conductor in a substantially spiral or coiled pattern, b) said embedded conductor within said aerogel diaphragm is placed in close proximity to a strong permanent magnet, said permanent magnet emanating an electromagnetic field of predetermined strength, c) said embedded conductor within said aerogel diaphragm is induced to couple to said electromagnetic field, d) said aerogel diaphragm being physically modulated by said acoustic signal, thereby modulates said embedded conductor within said aerogel diaphragm, causing said embedded conductor to change position relative to said electromagnetic field in correspondence with said modulation, wherein an electric current is generated within said embedded conductors, said electric current functioning as an electric signal in correspondence with said acoustic signal.

4. An acoustical transducer that converts between electrical energy and acoustic energy comprising:

a) an aerogel acoustical interface or aerogel membrane or aerogel transducer element or aerogel diaphragm, said aerogel diaphragm being formed from electrical field-reactive materials selected from the group consisting of conductive aerogels, conductive aerogel composites, magnetically inductive and magnetically permeable aerogels, and magnetically inductive and magnetically permeable aerogel composites, said aerogel diaphragm having at least one surface used as an acoustical interface, b) a means for converting between electrical energy and electrical field energy, said electrical field being directly coupled to said field-reactive materials of said aerogel diaphragm, said electrical field having a correspondence with the physical movement of said aerogel diaphragm, and c) an array of electromagnetic coils in combination with an aerogel diaphragm formed from a magnetically reactive material, said diaphragm being placed in close proximity to said array, disposing said aerogel diaphragm to electromagnetically couple to said array, said aerogel diaphragm having at least one surface for acoustical interface, said array providing means for a plurality of electromagnetic modulation modes, said modulation modes being in correspondence with an electrical audio signal, whereby acoustic energy is produced in correspondence with said electrical audio signal.

5. An acoustic transducer that converts between electrical energy and acoustic energy of claim 8 wherein said modulation modes is selected from the group consisting of amplitude modulation, Bessel array modulation, and phase array modulation.

6. An acoustic transducer that converts between electrical energy and acoustic energy of claim 4, wherein a complex array modulation mode is used to create a spatial acoustic effect similar to an acoustical portal or audio window, hereafter referred to as an audio window, said complex array modulation mode comprising one mode of said modulation modes, said complex array modulation mode being effected by means where said electromagnetic coils of said array are each configured to be independently electrically modulated, thereby disposing said array to generate a complex electromagnetic field, said field having a complex terrain of electromagnetic field densities substantially corresponding to a cross-sectional complex pressure gradient representing the acoustic content at the intersection of a planar cross-section of a complex acoustic signal, said complex electromagnetic field urging each portion of said aerogel diaphragm to move in correspondence with said field densities of said complex electromagnetic field, thereby projecting a complex acoustic image across said acoustical interface of said aerogel diaphragm, whereby said spatial acoustical effect referred to as said audio window is realized.

7. A method of converting an acoustical signal to an electrical signal comprising the steps of:

a) an aerogel diaphragm formed from electric field-reactive materials selected from the group consisting of conductive aerogels, conductive aerogel composites magnetically inductive and magnetically permeable aerogels, and magnetically inductive and magnetically permeable aerogels composites, and having at least one surface for acoustical interface, is induced to physically modulate by an acoustic signal in correspondence with said acoustic signal, b) an electrical field selected from a group consisting of electromagnetic fields and electrostatic fields is generated or imparted within said electric field-reactive material of said aerogel diaphragm by an electrical field generating means, c) an electrical field sensor or pick up transducer capable of generating an electrical output in correspondence with a change in electrical field strength is placed substantially within said electrical field emanating from said aerogel diaphragm, said electrical field sensor being kept at a fixed position in reference to the position of said aerogel diaphragm, d) said electrical field emanating from said aerogel diaphragm is spatially displaced or modulated in correspondence with the physical modulation of said aerogel diaphragm, the spatial displacement being perceived as a change in strength of said electrical field by the fixed electrical field sensor, whereby an electrical signal is created by said electrical field sensor in correspondence with said acoustic signal, e) said aerogel diaphragm being formed from conductive materials is effectively configured to be one potential and side of a condenser element or capacitor, with the other potential and side being a fixed conductive element placed in proximity to said aerogel diaphragm, the surface area of fixed conductive element being approximately shaped to correspond to the surface of said acoustical interface of aid aerogel diaphragm, said fixed conductive element also having means for acoustical transparency, f) said condenser element is configured with a bias voltage applied across the two potentials, one potential being directly connected to one side of said bias voltage, and the other side of said bias voltage being connected through a resistor to the opposite potential of said condenser element, with a relative charge corresponding to the capacitance across said condenser element, said capacitance being relative to the position of said aerogel diaphragm in reference to said fixed conductive element, and g) said aerogel diaphragm being physically modulated by said acoustic signal in reference to said fixed conductive element, effects a change in capacitance across said condenser element, thereby creating a modulated voltage differential across said resistor in correspondence with said modulated aerogel diaphragm, whereby said voltage differential provides for an electrical audio signal in correspondence with said acoustic signal.

8. A method of converting an acoustic signal to an electrical signal by an aerogel diaphragm and transducer of claim 7 wherein:

a) said aerogel diaphragm being formed from magnetic material and made with a permanent magnetic moment, and having an electromagnetic field created by said permanent magnetic moment, and having means of suspension that allows for the physical modulation of said aerogel diaphragm by said acoustic signal, said aerogel diaphragm is placed in close proximity to an electromagnetic sensing means, said sensing means providing for an electric signal as an output in correspondence with a detected change in electromagnetic field strength, b) said electromagnetic field of said aerogel diaphragm is caused to couple to said electromagnetic sensing means, c) said acoustic signal physically modulates said aerogel diaphragm, mutually displacing said diaphragm and said electromagnetic field emanating from said diaphragm, thereby effecting a change in the relative field strength of said electromagnetic field as detected by said electromagnetic sensing means, d) said electromagnetic sensing means produces a modulated electrical signal in correspondence with the detected modulated relative field strength, thereby providing for an electrical signal in correspondence with said acoustic signal.

* * * * *